US005493366A

United States Patent [19]

Satoh et al.

[11] Patent Number: 5,493,366

[45] Date of Patent: Feb. 20, 1996

[54] IMAGE FORMING APPARATUS

[75] Inventors: Hisao Satoh; Satoshi Haneda; Tadayoshi Ikeda; Shizuo Morita; Masakazu Fukuchi, all of Hachioji, Japan

[73] Assignee: Konica Corporation, Japan

[21] Appl. No.: 289,176

[22] Filed: Aug. 11, 1994

Related U.S. Application Data

[63] Continuation of Ser. No. 993,814, Dec. 18, 1992, abandoned, which is a continuation of Ser. No. 754,968, Sep. 4, 1991, abandoned.

[30] Foreign Application Priority Data

Sep. 7, 1990 [JP] Japan ..... 2-238474
Oct. 3, 1990 [JP] Japan ..... 2-265844

[51] Int. Cl.[6] ..... G03G 15/00

[52] U.S. Cl. ..... 355/210; 355/200; 355/211; 355/326 R

[58] Field of Search ..... 355/200, 211, 355/210, 326 R, 327; 346/151; 347/115, 172, 232

[56] References Cited

U.S. PATENT DOCUMENTS

| | | | |
|---|---|---|---|
| 4,625,895 | 12/1986 | Tsukano | 222/DIG. 1 |
| 4,634,264 | 1/1987 | Takahashi | 355/200 |
| 4,816,877 | 3/1989 | Keen | 355/260 X |
| 4,996,566 | 2/1991 | Morita et al. | 355/326 X |
| 5,030,988 | 7/1991 | Haneda et al. | 355/200 |
| 5,036,367 | 7/1991 | Haneda et al. | 355/326 X |
| 5,047,801 | 9/1991 | Haneda et al. | 355/200 |
| 5,065,195 | 11/1991 | Haneda et al. | 355/210 X |
| 5,287,161 | 2/1994 | Matsuo et al. | 355/326 R |
| 5,327,208 | 7/1994 | Matsuo et al. | 355/326 R |

FOREIGN PATENT DOCUMENTS

| | | | |
|---|---|---|---|
| 154255 | 9/1982 | Japan | G03G 15/00 |
| 1161 | 1/1983 | Japan | G03G 15/00 |
| 54392 | 12/1983 | Japan | G03G 21/00 |
| 147366 | 8/1984 | Japan | G03G 15/04 |
| 279870 | 12/1986 | Japan | G03G 15/00 |
| 244064 | 10/1988 | Japan | G03G 15/00 |
| 244059 | 10/1988 | Japan | G03G 15/00 |
| 244058 | 10/1988 | Japan | G03G 15/00 |
| 179168 | 7/1989 | Japan | G03G 15/00 |

*Primary Examiner*—Matthew S. Smith
*Attorney, Agent, or Firm*—Jordan B. Bierman; Bierman and Muserlian

[57] ABSTRACT

In an image forming apparatus having a detachable process cartridge in which an image carrier on which an electrostatic latent image is formed, and a developing unit which develops the electrostatic latent image so that a toner image can be formed, both integrally formed into one unit. There is provided a developer container including a discharge section which can be inserted into a supply opening of the developing unit, and a container in which a predetermined amount of developer is contained, wherein the developer container is provided to the toner supply opening of the developing unit and the developer is supplied into the developing unit housing when a toner stirring screw of the developing unit is rotated.

5 Claims, 18 Drawing Sheets

IMAGE FORMING APPARATUS

This application is a continuation of application No. 07/993,814, filed Dec. 18, 1992, now abandoned, which is a continuation of application No. 07/754,968, filed Sep. 4, 1991, now abandoned.

BACKGROUND OF THE INVENTION

The present invention relates to an image forming apparatus in which an image can be obtained in such a manner that: a toner image is formed on an image carrier by means of electrophotography; and the formed toner image is transferred onto a transfer sheet. The present invention more particularly relates to an image forming apparatus such as a printer, copier and facsimile in which a process cartridge including an image carrier on which an electrostatic latent image is formed, and a developing unit are detachably provided.

As the size of an image forming apparatus such as a printer and copier has been made small, and its function has been improved, the structure of the image forming apparatus has become highly precise and complicated.

Recently, an image forming apparatus having a process cartridge in which an image carrier and at least one of a developing means and a cleaning means are integrated into one unit, has been developed so that an operator can maintain the apparatus easily.

In the case of an image forming apparatus such as a printer and a copier having a process cartridge, when an image carrier provided in the process cartridge is consumed or deteriorated, the process cartridge itself is replaced with a new one, so that an operator can maintain the image forming apparatus without any expertise. In the apparatus described above, the apparatus is provided with a guide member by which the process cartridge can be guided, and all the operator must do is to insert the process cartridge into the apparatus along the guide member.

In a conventional image forming apparatus, the direction of process cartridge removal and that of transfer sheet movement make a right angle with each other, so that the work of process cartridge removal is troublesome and complicated, and further the space to install the image forming apparatus is restricted. Furthermore, a wide space is required to maintain the apparatus.

In order to solve the aforementioned conventional problems, an image forming apparatus disclosed in the official gazette of the Japanese Patent Publication Open to Public Inspection No. 279870/1986 has been proposed in the apparatus disclosed in the aforemention official gazette, the direction of the transfer sheet movement agrees with the direction of process cartridge removal, so that the parts can be easily replaced and the operation can be conducted easily, and further, the working space is not restricted.

However, in the case of the image forming apparatus disclosed in the official gazette of the Japanese Patent Publication Open to Public Inspection No. 279870/1986, the process cartridge is replaced in such a manner that: the upper housing of the apparatus is opened, and the operator must pull the process cartridge from the apparatus and then take it out. Therefore, the work is very hard for the operator when the process cartridge is large and heavy.

In the aforementioned conventional embodiment, the process cartridge is attached to and detached from the apparatus body under the condition that the upper housing is opened. Therefore, it is troublesome to attach the process cartridge to the apparatus body and it is also troublesome to detach it from the apparatus body.

Especially, in the case of a process cartridge in which an image carrier, a charging unit, and a plurality of developing units are provided, in general, the developing units are made separately from the process cartridge, so that it is difficult to assemble the developing units to the cartridge accurately and stably. Since she developing units are driven, it is necessary to maintain strength and accuracy. Therefore, the structure of the developing units necessarily becomes complicated. Further, the shape and structure of the process cartridge in which the developing units are provided, are complicated, so that there is a problem to maintain its mechanical strength. In order to maintain its accuracy, the number of parts of the process cartridge is increased so that the cost is inevitably raised. When accuracy of a process cartridge is not sufficiently high in the case of a color image forming apparatus, maintainability is deteriorated, so that color balance can not be sufficiently adjusted.

Further, the present invention relates to a process cartridge to be detachably provided to a printer, a copier or a facsimile, in which an image forming means including an image carrier on which an electrostatic latent image is formed, and including a developing unit which develops the electrostatic latent image so that a toner image can be formed, is integrated into one unit, and more particularly relates to a developer supply method which is used when new developer is supplied to the inside of the aforementioned developing unit.

When the aforementioned process cartridge is assembled or after it has been assembled, new developer is loaded into the developing tank of the process cartridge. Developer is loaded into the developing tank of the aforementioned process cartridge in such a manner that: members provided in the upper portion of the developing unit, for example, a cover of the apparatus and an image carrier, are removed; further an upper lid provided on the upper portion of the developing unit is removed so that the developing tank is opened; developer is loaded into the tank; and the tank is closed and fixed by the upper cover.

Since the above-described complicated work must be done, the following problems are caused: assembling efficiency of the process cartridge is lowered; and developer is scattered and the apparatus is stained by the scattered developer when developer is loaded.

Especially, in the case of a color image forming apparatus, the process cartridge is provided with a plurality of developing units, so that the aforementioned problems are frequently caused.

In an electrophotographic type of image forming apparatus such as a monocolor type of analog copier and a copier or a printer in which a semiconductor laser and LED is used, the following image forming apparatus is proposed: in order to replace a photoreceptor or supply developer carrier and toner, an essential portion of the image forming apparatus is integrated into a unit so that the unit can be taken out from the apparatus for maintenance. Various structures are proposed in which a transfer sheet passage is opened in order to remove a jammed transfer sheet from the apparatus.

A typical structure of the aforementioned image forming apparatus has been disclosed in the official gazette of Japanese Patent Publication No. 54392/1983, in which a photoreceptor drum, a developing unit and a cleaner are integrally mounted on a support member so that they can be easily withdrawn from the apparatus for replacement and maintenance of the aforementioned units. An image forming apparatus in which the aforementioned units are integrated into one disposable unit, has been disclosed in the official gazette of Japanese Patent Publication Open to Public Inspection No. 154255/1982. A printer in which the same disposable cartridge as described above is used, and in which a latent image is formed on a photoreceptor drum by an exposure scanning writing system using a semiconductor laser, has been disclosed in the official gazette of Japanese Patent Publication Open to Public Inspection No. 147366/1984. In these official gazettes, the structure is disclosed in which an upper housing is opened so that a jammed transfer sheet can be removed from a transfer sheet passage. According to the aforementioned official gazette of Japanese Patent Publication Open to Public Inspection No. 154255/1982, a disposable process cartridge is detachably provided to an upper housing which is composed of two portions, so that the cartridge can be replaced quickly and a jammed paper can be removed easily. According to the official gazette of Japanese Patent Publication Open to Public Inspection No. 1161/1983, a housing is composed of two portions in order to improve workability of cartridge replacement, and a process cartridge is detachably provided to the lower housing so that maintainability can be improved. According to the official gazettes of Japanese Patent Publication Open to Public inspection Nos. 244058/1988, 244059/1988, 244064/1988, and 179168/1989, a vertical type of process cartridge has been disclosed, wherein units are vertically arranged so that the operation can be performed from one side and jam clearance can be performed effectively.

However, in order to detach the process cartridge from the apparatus body, the housing must be composed in such a manner that it can be split, and at the same time the gears of a drive system to drive a photoreceptor and developing unit must be positively engaged with each other when the cartridge is attached to the apparatus, and disengaged when the cartridge is detached from the apparatus. Accordingly, the structure becomes complicated, and further its operation is not simple.

Further, the present invention relates to a color image forming apparatus such as a printer, copier and facsimile in which a process cartridge including an image carrier on which an electrostatic latent image is formed, and a plurality of developing units to develop the electrostatic latent image to form a color toner image, is detachably provided to the apparatus body, and more particularly relates to supply of color developer to a developing unit installed in the aforementioned process cartridge.

There is a possibility that a wrong color developer is loaded into a developer tank when a color developer is loaded before a new process cartridge is assembled to the aforementioned color image forming apparatus.

When the developer is loaded into the developing tank, the cover of the process cartridge and the image carrier must be removed, and further the upper lid of the developing unit must be removed so that the developing tank can be opened. After the developer has been loaded, the aforementioned members must be assembled and fixed so that the loaded developer can be securely enclosed. Accordingly, much labor is required to assemble the image forming apparatus, and workability is lowered. Furthermore, the following problems are caused: when a developer is loaded, it scatters and stains surrounding units and the apparatus floor; and the operator body and clothes may become stained.

When a new image forming apparatus is delivered from a factory, the aforementioned process cartridge for forming a color image having a plurality of developing units is not loaded with developer, so that adjustment of color balance can not be conducted since print output can not be obtained from the process cartridge. Therefore, quality of the apparatus can not be guaranteed.

SUMMARY OF THE INVENTION

The first object of the present invention is to provide a color image forming apparatus having a process cartridge in which assembling accuracy of a developing unit can be improved and stabilized, color balance of image formation can be stabilized, maintainability of developing units and an image carrier can be improved, and the cost can be lowered by reducing the number of parts.

The second object of the present invention is to provide a developer supply method of a color image forming apparatus by which workability can be improved when a developing unit is assembled, scattered developer can be prevented when the developer is loaded, and maintainability can be improved.

The third object of the present invention is to provide an image forming apparatus in which a process cartridge can be easily and positively attached to and detached from the apparatus without opening an upper lid in the same manner with an apparatus having a split type of housing.

The fourth object of the present invention is to provide a color image forming apparatus in which a failure in color developer supply can be prevented, workability can be improved when developer is loaded, and environmental pollution caused by leaked and scattered developer, can be prevented.

In an image forming apparatus having a detachable process cartridge provided with an image carrier on which an electrostatic latent image is formed, and provided with at least one developing; unit, the first structure of the image forming apparatus of the present invention is to integrally form a casing of the aforementioned developing unit inside a housing of the aforementioned process cartridge.

In the image forming apparatus of the present invention, the aforementioned image carrier and a support member of the image carrier are integrally formed into a unit, and the image carrier can be arranged in a position opposed to the developing unit provided in the aforementioned housing when positioning of the aforementioned unit is conducted by lowering it into the aforementioned housing.

In an image forming apparatus having a detachable process cartridge in which an image carrier on which an electrostatic latent image is formed, and a developing unit which develops the electrostatic latent image so that a toner image can be formed, both integrally formed into one unit, the second structure of the image forming apparatus of the present invention is to provide a developer container including a discharge section which can be inserted into a supply opening of the aforementioned developing unit, and a container in which a predetermined amount of developer is contained, wherein the developer container is provided to the aforementioned toner supply opening of the developing unit and the developer is supplied into the developing unit housing when a toner stirring screw of the aforementioned developing unit is rotated.

In this image forming apparatus of the present invention, the aforementioned process cartridge is provided with a plurality of developing units, and developers of different colors contained in the aforementioned developer containers are supplied from the aforementioned developer supply opening of the developing units.

In the third structure of a color image forming apparatus of the present invention in which a process cartridge including at least an image carrier and cleaning unit is detachably provided, the process cartridge can be taken out in the opposite direction to a transfer section, and a portion of the outer wall of the aforementioned cleaning unit is formed into a shape of a handle.

In a color image forming apparatus in which a detachable cartridge is provided including at least an image carrier on which an electrostatic latent image is formed and a plurality of developing units, the fourth structure of the present invention is composed in such a manner that: after predetermined developers have been loaded in the developer containers of the aforementioned plurality of developing units which are formed in the lower portion of the process cartridge housing, the developing units are assembled, and then the image carrier arranged in the upper portion of the developing unit is assembled.

DESCRIPTION OF THE PREFERRED EMBODIMENTS

Referring to the first embodiment shown in the attached drawings, the present invention will be explained as follows.

Figure 1:
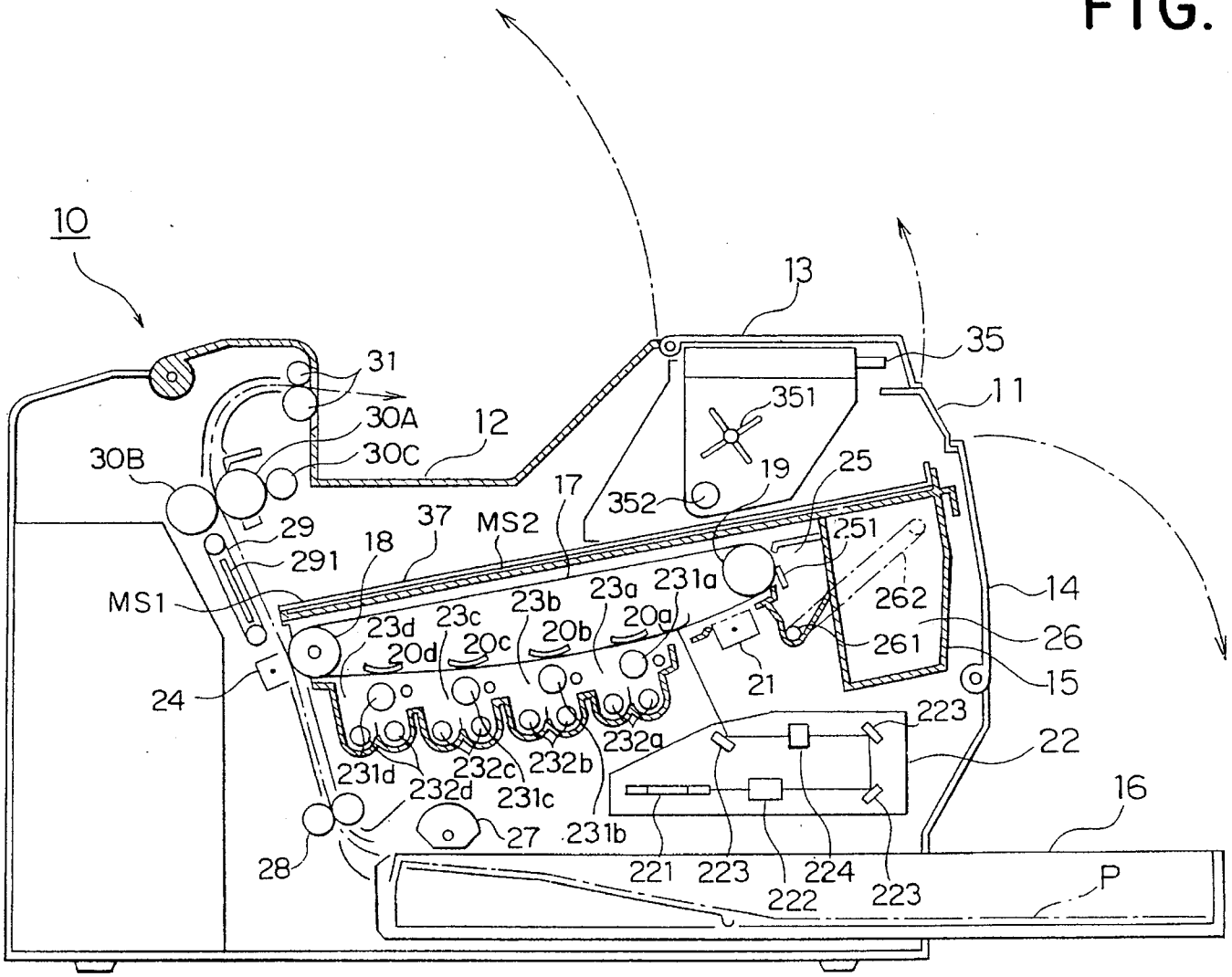
FIG. 1 is a left side main sectional view of a color printer to which the image forming apparatus of the present invention is applied.

FIG. 1 is a left side sectional view of the main portion of the color printer to which the present invention is applied. An apparatus body 10 is surrounded by an operation panel 11 which is located in the front portion, an upper cover (an upper lid member) 12 which can be freely opened and closed, a toner supply cover 13, and a front cover 14. A detachable process cartridge 15 and a paper feed cassette 16 are provided inside the apparatus body 10.

In FIG. 1, a photoreceptor belt 17 which is an image carrier, is made in such a manner that a photosensitive layer such as an organic photoconductive layer is coated on the surface of a flexible belt. The photoreceptor belt 17 is wound around a drive roller 18 and an idle roller 19. The drive roller 18 is rotated by a gear which meshes with a gear provided in the apparatus body 10, which will be described later, so that the photoreceptor belt 10 can be rotated clockwise. The distances between a plurality of developing units 23*a*, 23*b*, 23*c*, 23*d* and the photoreceptor belt 17 can be maintained constant by gap keeping plates 20*a*, 20*b*, 20*c*, 20*d*, so that an image of high quality can be stably formed. In this embodiment, the photoreceptor belt 17 is used for an image carrier. However, she present invention is not limited to the specific embodiments. Other image carriers such as a photoreceptor drum can be used.

Around the photoreceptor belt 17 are provided a charging means, an exposure means, a developing means, a transfer means, and a cleaning means.

The charging means is provided for the purpose of uniformly charging the photosensitive layer on the surface of the photoreceptor belt 17 to a predetermined polarity. A conventional charging unit such as a corona charger and a scorotron charger is used for the charging unit 21, and the scorotron charger is preferably applied to a photoreceptor of an organic photoconductive layer (OPC).

A semiconductor laser writing system unit 22 is used for the exposure means. The exposure means exposes the surface of the photoreceptor belt 17 which is charged by the charging unit 21, so that an electrostatic latent image is formed on the photoreceptor belt 17.

The developing means includes a plurality of developing units 23*a*, 23*b*, 23*c*, 23*d* in which developers of various colors, for example yellow, magenta, cyan and black, are contained. The developing units 23*a*–23*d* are provided with developing sleeves 231*a*–231*d*, the gaps between the developing sleeves and the photoreceptor belt 17 are maintained to be a predetermined value, and provided with stirring screws 232*a*–231*d*, so that the developing means changes an electrostatic latent image on the photoreceptor belt 17 into a visualized image by a noncontact developing method. The non-contact developing method is different from a contact developing method, and can obtain a color image of high quality since an image previously formed on the photoreceptor belt 17 is not damaged during the developing process, and the movement of the photoreceptor belt is not interrupted by the developing units. The developing means is not limited to a color development in which 4 different color toners are utilized, and toners of a mono-color, 2 colors or 3 colors may be used. In this case, developing units, the number of which is the same as that of toner colors, may be provided around the photoreceptor belt 17.

The transfer means transfers a toner image formed on the photoreceptor belt 17 onto transfer sheet P with the transfer unit 24. Instead of the transfer unit 24, a conventional transfer member such as a transfer drum may be used.

The cleaning means 25 is provided with a cleaning blade 251 which is maintained, being separated from the surface of the photoreceptor belt 17 while an image is being formed. Only when cleaning is conducted after the toner image has been transferred onto a transfer sheet, the cleaning blade 251 is contacted with the surface of the photoreceptor belt 17 with pressure so that a cleaning operation can be conducted.

Residual toner is removed by the cleaning means 25 from the surface of the photoreceptor belt 17, and the toner is recovered into a toner recovery box 26 by a used toner screw 261 through a Loner recovery tube 262.

In this embodiment, process sections such as the photoreceptor belt 17, the charging unit 21, the developing units 23*a*–23*d* in which toner of each color is held, the cleaning means 25, and the toner recovery box 26 are integrated in a process cartridge 15 so that they can be formed into a unit, and all of the aforementioned units can be attached to and detached from the apparatus body all at once. However, the process sections to be integrated into the process cartridge 15 are not limited to the aforementioned units. At least the photoreceptor belt 17 and the developing units 23*a*–23*d*, or the photoreceptor belt 17 and the cleaning means 25, are satisfactorily integrated into one unit, and other process sections may be integrated into the unit together.

Image formation is conducted as follows in the color image forming apparatus having the above-described structure.

First, the process cartridge 15 is set to the first position in the image forming apparatus body 10 so that an image can be formed. When the image signal of the first color which is outputted from an image reading unit separated from the apparatus body 10, is inputted into the aforementioned laser writing system unit 22, a laser beam is generated by a semiconductor laser (not illustrated in the drawing) in the laser writing system unit 22. The laser beam is rotationally scanned by a polygonal mirror 221 which is rotated by a motor (not illustrated in the drawing), and then the laser beam is directed onto the peripheral surface of the photoreceptor belt 17 previously charged to a predetermined charge by the charger 21, through an fθ lens 222, a cylindrical lens 224 and three mirrors 223, so that a bright line is formed on the peripheral surface of the photoreceptor belt 17.

On the other hand, concerning the auxiliary scanning direction, when a belt index (not shown in the drawing) corresponding to a specific position of the photoreceptor belt 17 is detected, or when a print command signal is inputted, the primary scanning line from which the modulation of a semiconductor laser is started according to the image signal, is determined on the basis of the detection signal or the command signal. Then, the scanning is conducted as follows. Concerning the primary scanning direction, the laser beam is detected by an index sensor (not shown in the drawing). On the basis of the detected signal, the modulation of the semiconductor laser is started according to the image signal of the first color, and the surface of the photoreceptor belt 17 is scanned by the modulated laser beam. Accordingly, a latent image corresponding to the first color is formed on the surface of the uniformly charged photoreceptor belt 17 by the primary scanning conducted by the laser beam and the auxiliary scanning conducted by conveyance of the photoreceptor belt 17. The latent image formed in the manner described above is developed by a developing unit 23*a* in which yellow toner is provided so that a yellow toner image can be formed on the surface of the photoreceptor belt 17. The photoreceptor belt 17, on the surface of which the yellow toner image is formed, passes under the cleaning blade 251 which is separated from the surface of the photoreceptor belt 17, and then image formation of the second color starts.

The latent image of the second color is formed as follows. The photoreceptor belt 17 on which the yellow toner image is formed, is charged by the charging unit 21 again, and then the image signal of the second color is inputted into the aforementioned laser writing system unit 22 so that writing can be conducted on the surface of the photoreceptor belt 17 according to the image signal in the same manner as the first color. The formed latent image is developed by the developing unit 23*b* in which magenta toner is provided, wherein magenta is the second color. The magenta toner image is formed on the yellow toner image which has been already formed.

In the same manner described above, a latent image formed by the image signal of the third color is developed by the developing unit 23*c* in which cyan toner is provided so that a cyan toner image can be formed. Further, a latent image formed according to the image signal of the fourth color is developed by the developing unit 23*d* in which black toner is provided so that a black toner image can be formed on the surface of the photoreceptor belt 17. A color toner image is formed on the surface of the photoreceptor belt 17 by registrating the toner images in the aforementioned manner.

A bias of DC or AC is applied to the developing sleeves 231*a*–231*d* of the developing units 23*a*–23*d* so that reversal development (jumping development) can be conducted on the photoreceptor belt 17 connected to earth, under the condition of non-contact. Either a one-component developer or a two-component developer can be used for non-contact development. When a one-component developer is used, it is not necessary to install a toner hopper independently, so that the size of the apparatus can be reduced. However, from the viewpoint of stability of development, the two-component developer is superior to the one-component developer, and preferably used.

The color toner image formed on the surface of the photoreceptor belt 17 in the aforementioned manner, is transferred onto a transfer sheet which is sent from the paper feed cassette 16 by the paper feed roller 27 and timed to the formation of the aforementioned color toner image by the timing roller 28. A high voltage, the polarity of which is inverse to that of the toner, is applied to the transfer unit 24 so that transfer can be conducted.

The transfer sheet P onto which the color toner image is transferred, is positively separated from the photoreceptor belt 17 which is sharply curved around the drive roller 18, and then the transfer sheet P is conveyed upward by the conveyance belt 29. The conveyance belt 29 is provided with a suction means 291, and the transfer sheet P is positively conveyed upward while it is sucked by the suction means 291. Then, the toner image on the transfer sheet P is thermally fixed by heat press of the fixing roller 30A and the press roller 30B. After that, the transfer paper is discharged onto the upper surface of the upper cover 11 which is also used for a discharge paper tray.

After the toner image has been transferred onto the transfer paper P, the photoreceptor belt is further rotated clockwise, and the residual toner on the photoreceptor belt is removed by the cleaning blade 251 of the cleaning means 25 which is contacted with the photoreceptor belt 17 with pressure. After cleaning has been completed, the cleaning blade is separated again from the surface of the photoreceptor belt 17 so that a new image forming process is started.

Next, referring to FIG. 2 and FIG. 3, the drive system of the process cartridge 15 and that of process cartridge movement will be explained as follows.

Figure 2:
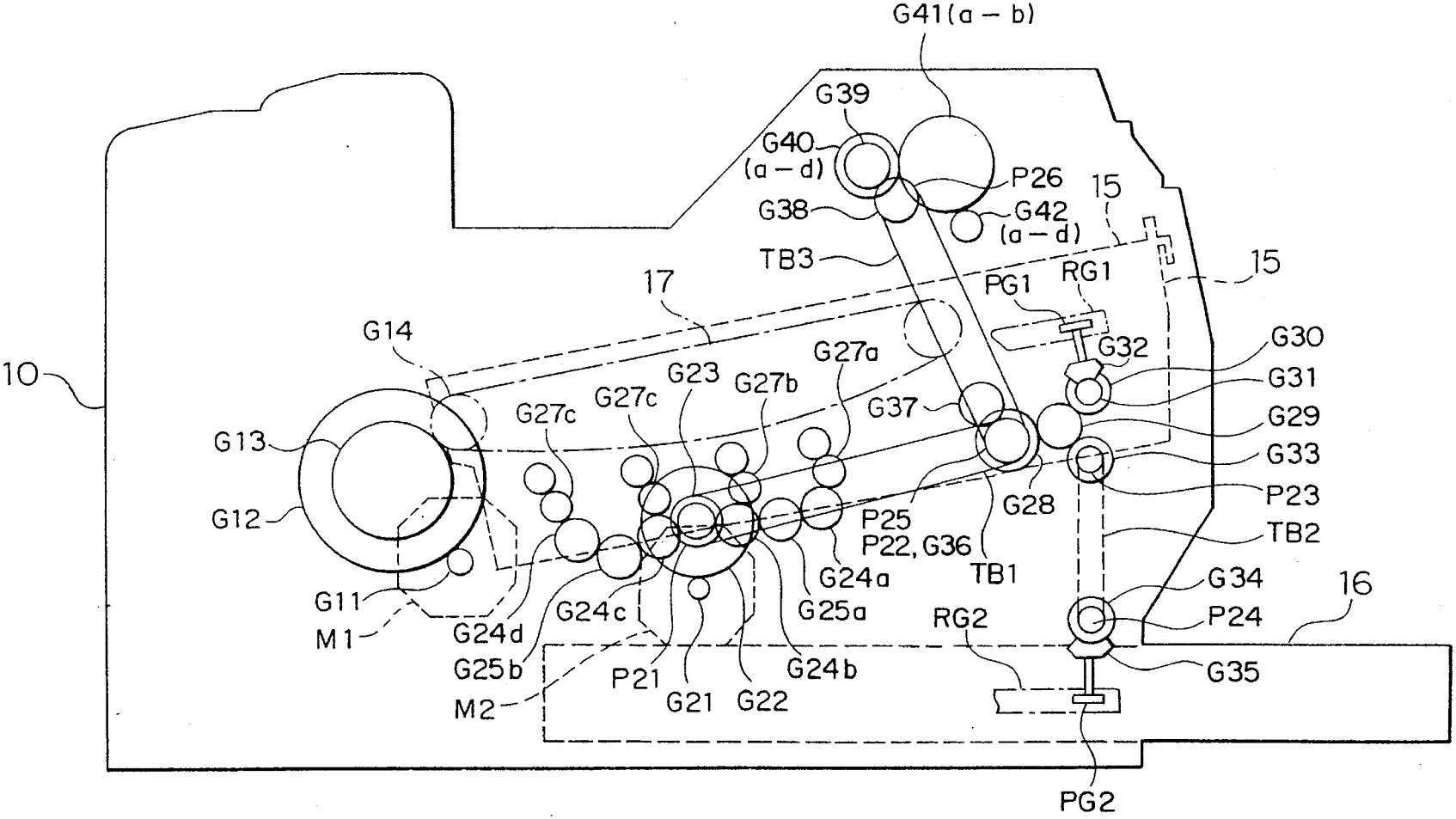
FIG. 2 is a schematic illustration of the drive system of the aforementioned image forming apparatus.
Figure 3:
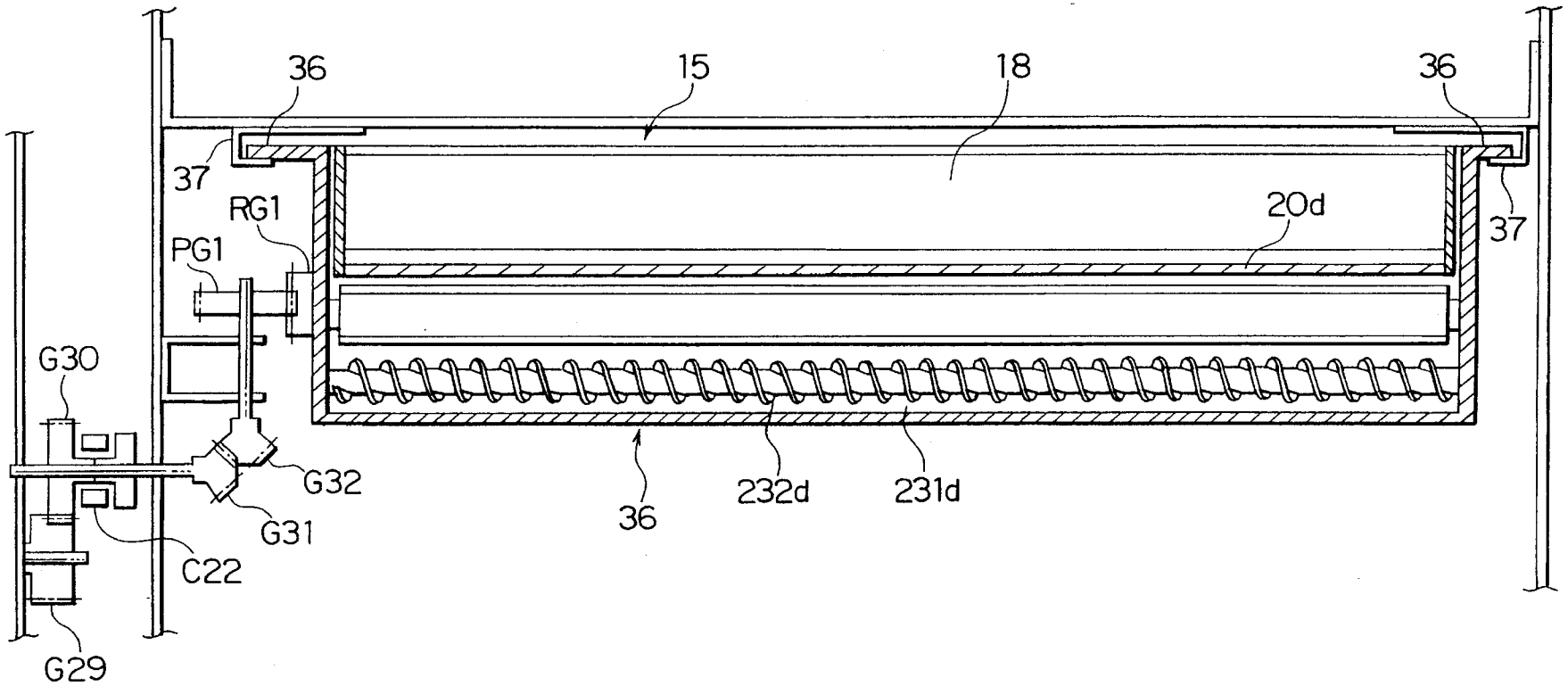
FIG. 3 is a front sectional view showing the essential portion of the drive system of process cartridge movement.

FIG. 2 is a schematic illustration of the left side of the drive system of the image forming apparatus, that of process cartridge movement, and that of cassette movement. FIG. 3 is a front sectional view of the process cartridge 15 and the drive system. The aforementioned three drive systems in this embodiment are driven by two motors, M1 and M2.

The drive system of the photoreceptor belt 17 is driven by motor M1. Gear G12 meshes with gear G11 mounted on the shaft of motor M1. When the process cartridge 15 is placed in a position where image formation can be conducted, drive gear G14 which is provided to the same shall as that of the drive roller 18, meshes with gear G13 which is rotated integrally with gear G12. Namely, the rotation of motor M1 is transmitted to drive gear G14 through gears G11, G12, and G13 so that the rotation speed can be adjusted to an appropriate value. The rotation of motor M1 is further transmitted to the drive roller 18 so that it can be rotated together with drive gear G14 counterclockwise in the drawing, and the photoreceptor belt 17 can be rotated.

Motor M2 is used to drive the drive system of the developing units 23*a*–23*d*, that of the used toner screw 261, and that of the toner hopper 35. The rotation of motor M2 is transmitted to gear G22 through gear G21 provided to the shaft of motor M2. The rotation is further transmitted to gear G23 which is integrally provided on the same shaft as that of gear G22 so that the drive system of the developing units 23*a*–23*d*, that of movement of the process cartridge 15, that of movement of the paper feed cassette 16, that of the toner supply unit 35, and that of the used toner recovery unit 26, can be driven..

The drive system of the developing units 23*a*–23*d* will be explained as follows.

Torque of motor M2 is transmitted to gears G26*a*, G26*b*, G26*c*, G26*d* through gears G21, G22, G23, an intermediate gear, and a spring clutch so that the gears can be rotated.

These gears G26*a*–G26*d* mesh with developing unit drive gears G27*a*–G27*d* provided in the process cartridge 15. Torque transmitted to the developing unit drive gears G27*a*–G27*d* is further transmitted to the developing sleeves 231*a*–231*d* and the stirring screws 232*a*–232*d* so that the developing units can be driven.

Torque of motor M2 transmitted to the aforementioned pulley P22 is transmitted to the used toner screw 261 through the used toner drive system including a clutch and gear train so that the used toner screw 261 can be driven.

Torque of motor M2 transmitted to the aforementioned pulley P22 is transmitted to the toner supply screw of the toner hoppers 35*a*–35*d* and the toner stirring member through the toner supply drive system including a clutch, a gear train and a timing belt.

In this embodiment, two motors M1 and M2 are used to drive the drive system of the photoreceptor belt 17 and the drive system of the developing units 23*a*–23*d*, the used toner screw 261, the toner hoppers 35*a*–35*d*, the process cartridge moving means, and the cassette moving means. The aforementioned units may be driven by one motor so that they can be selectively driven by the motor, using a change-over means such as a clutch.

Motors may be exclusively provided to the process cartridge moving means and the cassette moving means so that they can be driven separately from the power source of the image forming means.

Next, the movement means of the process cartridge will be explained as follows. FIG. 3 is a front sectional view of the drive and transmission system of the process cartridge moving means.

The rotation of motor M2 transmitted to gear G22 is transmitted to pulley P22 through rotating pulley P21 and timing belt TB1, and the rotation is also transmitted to gear G29 which meshes with gear G28 rotating integrally with pulley P22. The rotation transmitted to gear G29 is further transmitted to gear G30 which meshes with gear G29. When necessary, the rotation is transmitted to gear G31 through electromagnetic clutch C22. Gear G31 and gear G32 are bevel gears, and the rotation transmitted to gear G31 is transmitted to pinion gear PG1. The aforementioned pinion gear PG1 can mesh with rack gear RG1 which is provided on the side of the process cartridge 15, and the process cartridge 15 is laterally moved when pinion gear PG1 is rotated and rack gear RG2 is slid, as shown in FIG. 2.

The protruded member 36 and rack gear RG1 used for movement are provided on the side of the process cartridge 15. Further, drive gear G14 to rotate the photoreceptor belt 17, drive gears G27*a*–G27*d* to drive the developing units, and drive gear G37 to drive the used toner screw, are provided in the process cartridge 15.

The following are provided in the process cartridge holding chamber in the apparatus body 10: the guide member 37 which engages with a flange portion 361 of a housing 36 of the process cartridge 15 so that the process cartridge can be suspended; and gear G13, gears. G26*a*–G26*d*, and gear G36 which correspond to gear G14 to drive the process cartridge 15, gears G27*a*–G27*d* to drive the developing units, and gear G34 to drive the used toner screw. Pinion P1 is provided in such a manner that pinion gear PG1 can mesh with rack gear RG1 mounted on the process cartridge 15.

The first microswitch MS1 and the second microswitch MS2 are mounted on the aforementioned guide member 37. The aforementioned first microswitch MS1 and the second microswitch MS2 are detection means to detect the position of the process cartridge 15. In this case, the first microswitch MS1 detects the first position in which image formation can be conducted in such a manner that: drive gear G14, gears G27*a*–G27*d* to drive developing units, and gear G37 to drive the used toner screw, which are provided to the process cartridge 15, mesh with gear G13, gears G26*a*–G26*d*, and gear G36, which are provided to the apparatus body 10. The second microswitch MS2 detects the second position which is further apart from the transfer unit 24 as compared with the first position, in other words, the second position is defined as a position to which the process cartridge 15 is withdrawn in the opposite direction of the process cartridge insertion. The microswitches MS1 and MS2 output the positional signal to the control section.

Figures 4A, 4B, 4C:
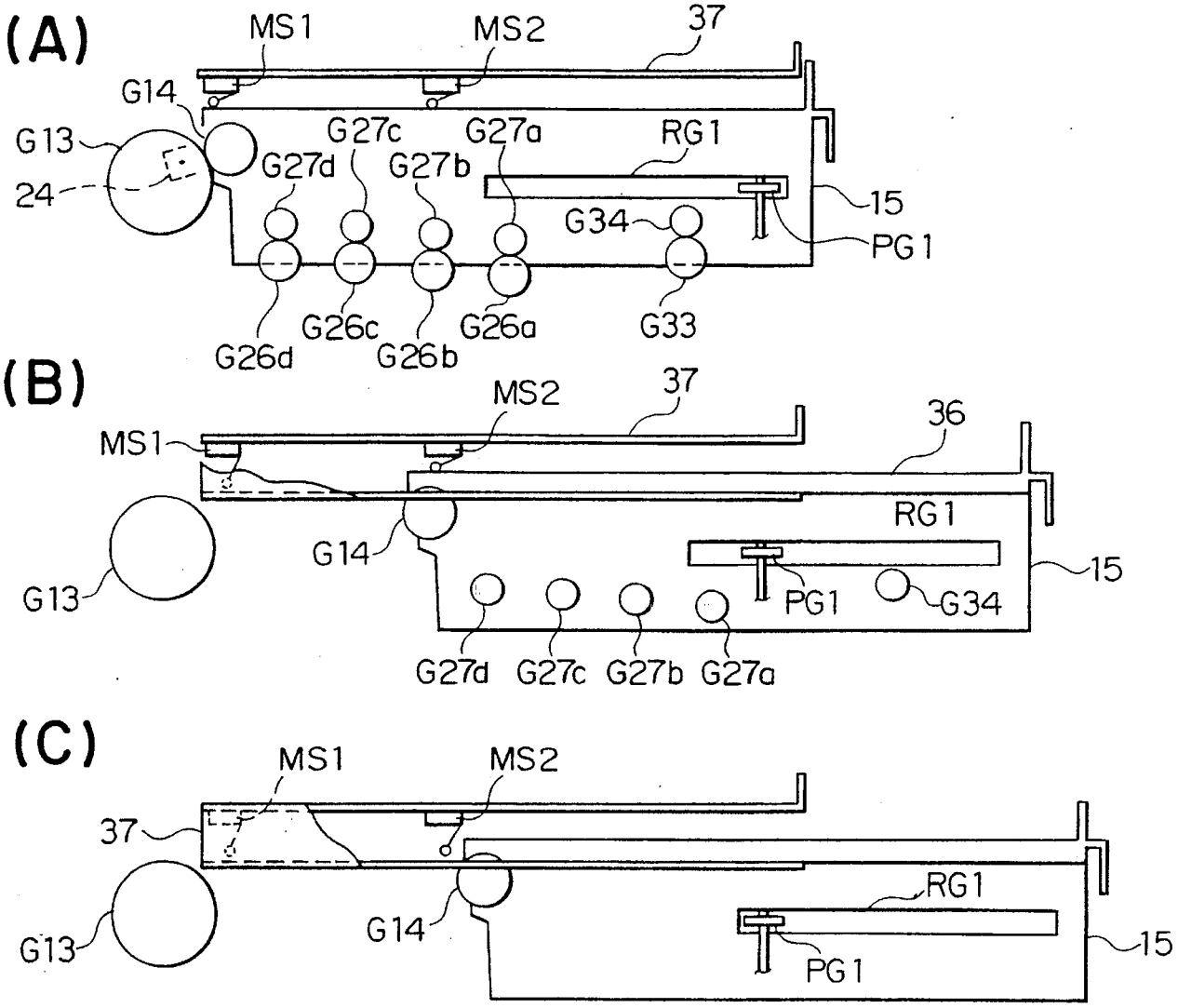
FIG. 4 is an illustration showing a model of the process cartridge moving process

Referring now to FIG. 4(A)–4(C) in which a model of the process cartridge 15 is shown, the movement of the process cartridge will be explained as follows.

First, a case in which the process cartridge 15 is taken out from the apparatus 10 will be explained. As shown in FIG. 4(A), the process cartridge 15 is in the first position so that the distance between the drive roller 18 and the transfer unit 24 is maintained to be a predetermined value (in the case of a transfer drum, appropriate contact pressure is maintained). Drive gear G14, gears G27*a*–G27*d* to drive developing units, and gear G37 to drive the used toner screw, which are provided to the process cartridge 15, mesh with gear G13, gears G26*a*–G26*d*, and gear G36, which are provided to the apparatus body 10, so that the apparatus is in the most optimum state for image formation. Rack gear RG1 meshes with pinion gear PG1.

The jam judging section receives the signal sent from jam detection sensors, and judges whether a jam has occurred or not. When it is judged that a jam has occurred, the jam judging section sends a jam signal to the control section. Then, the control section stops the drive sections for image formation such as the photoreceptor belt drive section, the developing unit drive section, and the fixing unit drive section. At the same time, the control section controls the process cartridge moving means. In other words, the control section moves the process cartridge 15 in the direction of the second position along the guide member 37 in such a manner that: the control section sends a signal to motor M2 and electromagnetic clutch C22 which are the drive section of the process cartridge moving means, so that pinion gear PG1 can be rotated in order to move the process cartridge 15 from the first to the second position and the process cartridge 15 is moved along the guide member 37 in the direction of the second position. (Refer to FIG. 4(B).)

When the process cartridge 15 is moved as shown in FIG. 4(C), the second microswitch MS2 detects that the process cartridge 15 has moved to the second position, and the detection signal is sent to the control section. When the signal is inputted into the control section, the control section releases electromagnetic clutch C22 and stops the rotation of motor M2. That is, the process cartridge 15 withdraws from the first position to the second position and stops at the second position while rack gear RG1 meshes with pinion gear PG1.

Next, the moving means of the paper feed cassette will be explained.

In FIG. 2, the rotation of motor M2 transmitted to gear G29 is transmitted to gear G33 which meshes with gear G29. When necessary, the rotation is transmitted to pulley. P22 through electromagnetic clutch C23, and the rotation is further transmitted to pulley P24 through timing belt TB2. Furthermore, the rotation is transmitted to gear G34 which is rotated integrally with pulley P24. Gear G34 and gear G35 are bevel gears, and the rotation transmitted to gear G34 is transmitted to pinion gear PG2. The aforementioned pinion gear PG2 can mesh with rack gear RG2 which is provided on the side of the cassette 16, and the cassette 16 is laterally moved when pinion gear PG2 is rotated and rack gear RG2 is slid.

The jam judging section receives the signal sent from jam detection sensors (not shown in the drawing) which are provided in the transfer paper conveyance passage passing through the paper feed section, the transfer section, the fixing section and the paper discharging section, and the jam judging section judges whether a jam has occurred or not. When the occurrence of a jam has been detected, the jam judging section sends a jam signal to the control section. Then, the control section stops the drive sections for image formation such as the photoreceptor belt drive section, the developing unit drive section, and the fixing unit drive section. At the same time, the control section sends a movement signal to the process cartridge moving means and the cassette moving means, and further sends an opening signal to the upper cover opening means. The process cartridge moving means section controls the process cartridge moving drive system which moves the process cartridge 15 from the first to the second position. When a positional detection signal that the process cartridge 15 has moved to the second position, is obtained, the process cartridge movement drive system is stopped.

Figure 5:
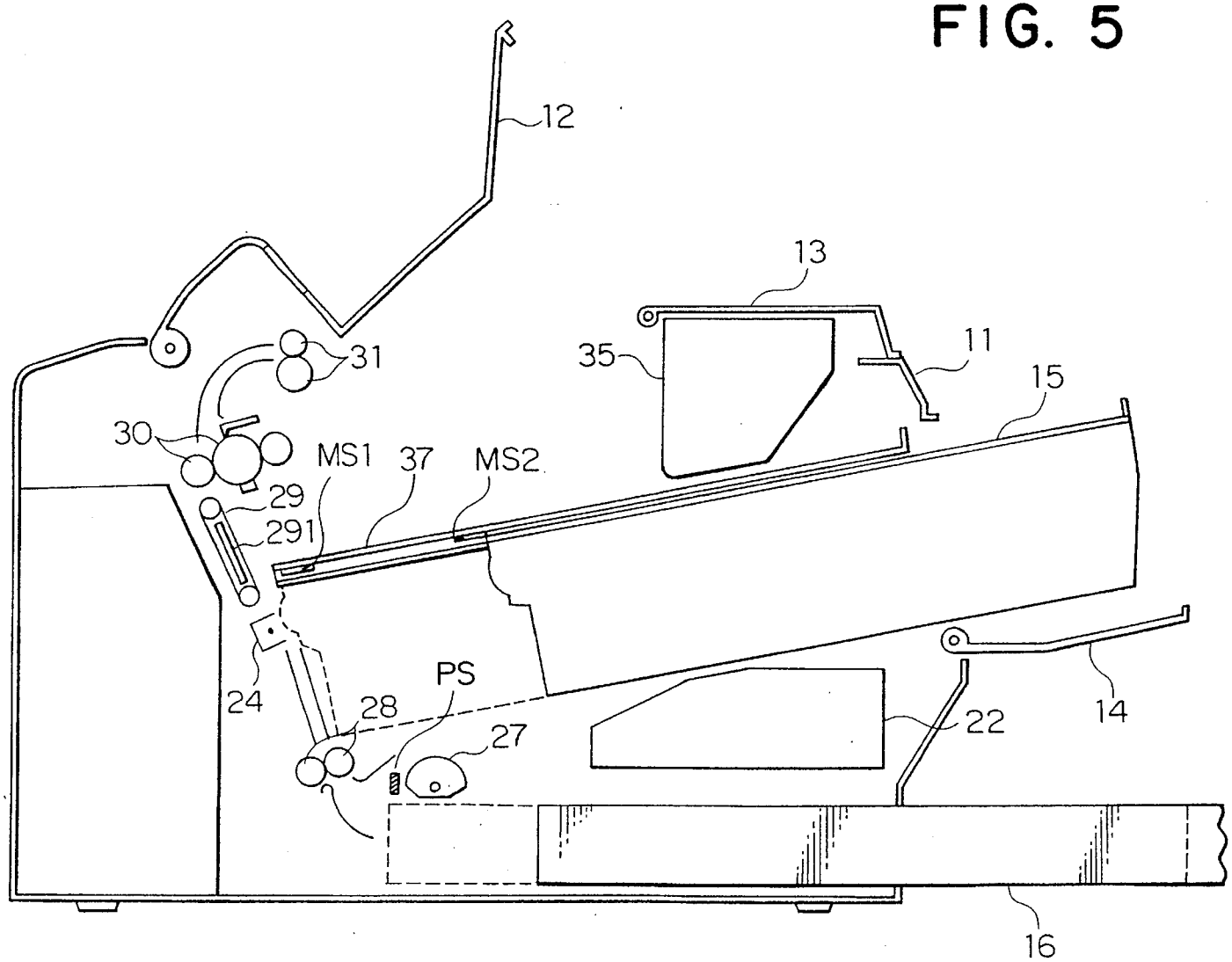
FIG. 5 is a side sectional view showing an image forming apparatus in the condition that an upper cover and front cover are opened so that a process cartridge and paper feed cassette are withdrawn.

In the same manner as described above, the paper feed cassette moving means moves the paper feed cassette from the first to the second position. On the other hand, the upper cover opening means opens the upper cover 12. In other words, it is not necessary for an operator to move the process cartridge 15 and the paper feed cassette 16. While an operation is not conducted by the operator, the process cartridge 15 and the paper feed cassette 16 are withdrawn to the second position as illustrated in FIG. 5, and the upper cover is opened, so that a jammed transfer sheet P can be easily checked and removed from the apparatus body. In the case where transfer paper P is jammed being pinched by the fixing roller 30A and the press roller 30B of the fixing unit, the jammed transfer sheet can be easily removed when the upper cover 12 is opened and both rollers are released automatically or manually. After the jam clearance has been completed, the process cartridge 15 and the paper feed cassette 16 are automatically inserted into the apparatus by a simple operation, so that the labor of the operator can be greatly reduced, and furthermore the process cartridge 15 and the paper feed cassette 16 can be set to the most appropriate position.

Figure 6:
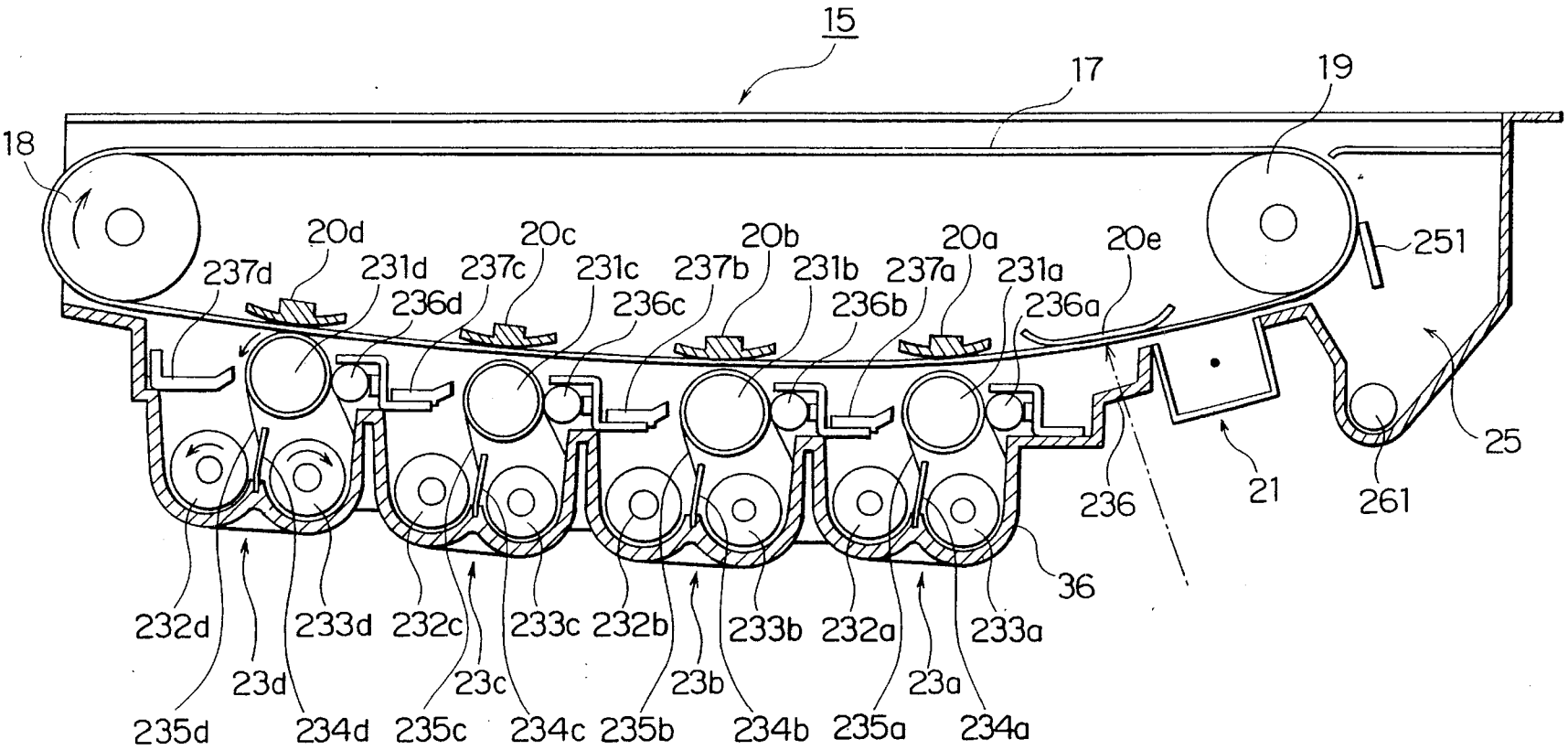
FIG. 6 is a sectional view according to the present invention.
Figure 7:
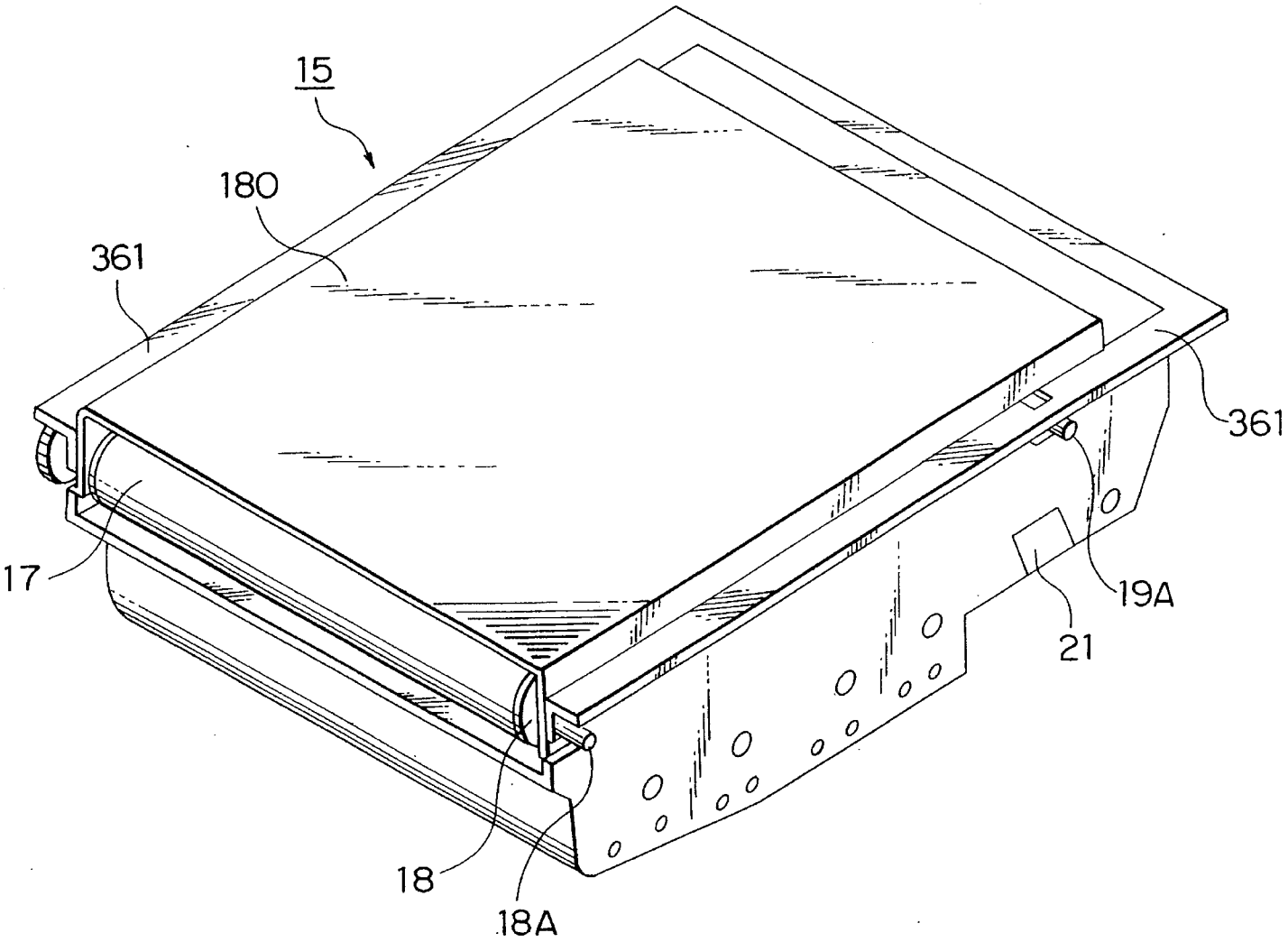
FIG. 7 is a perspective view of the process cartridge.
Figure 8A:
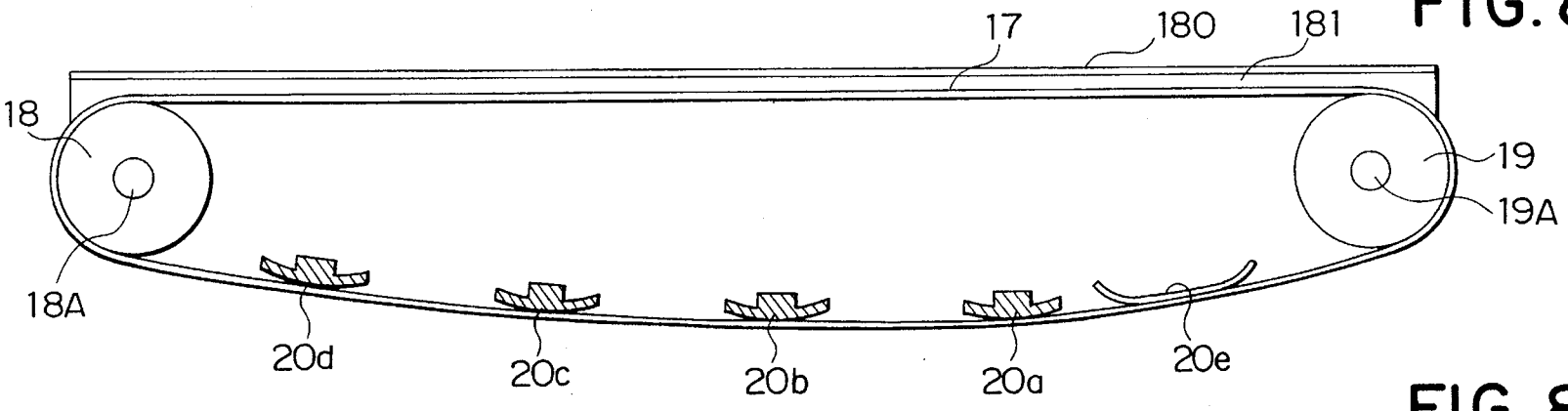
FIG. 8(A) and FIG. 8(B) are exploded sectional view of the process cartridge.
Figure 8B:
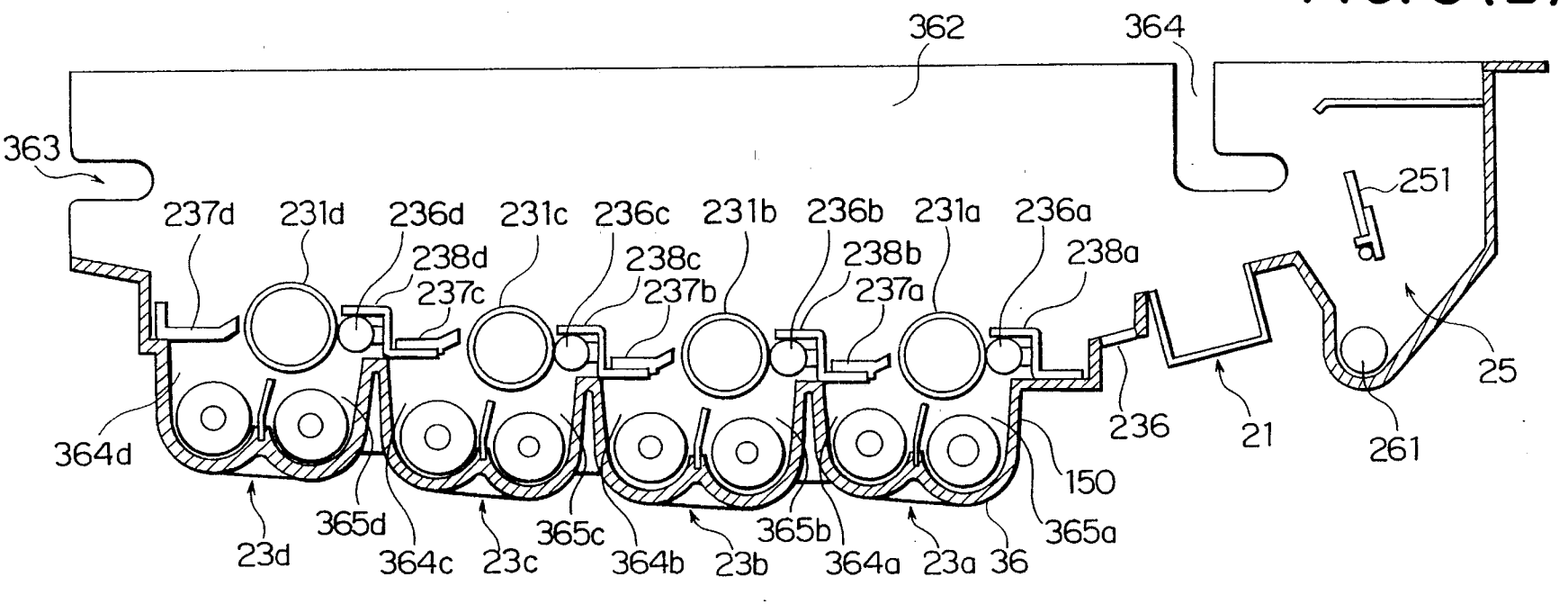
Figure 9:
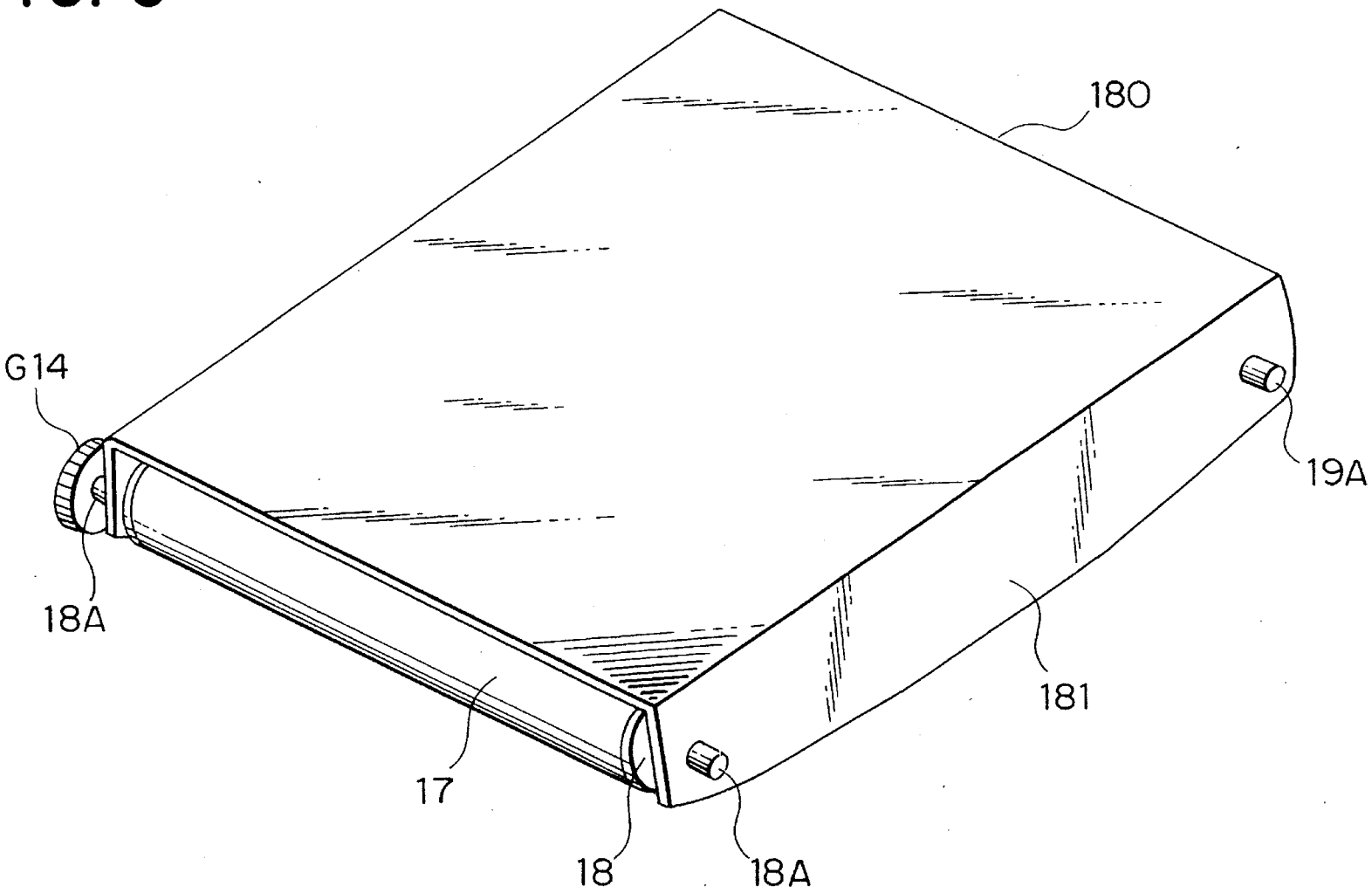
FIG. 9 is a perspective view of the upper unit of the process cartridge.
Figure 10:
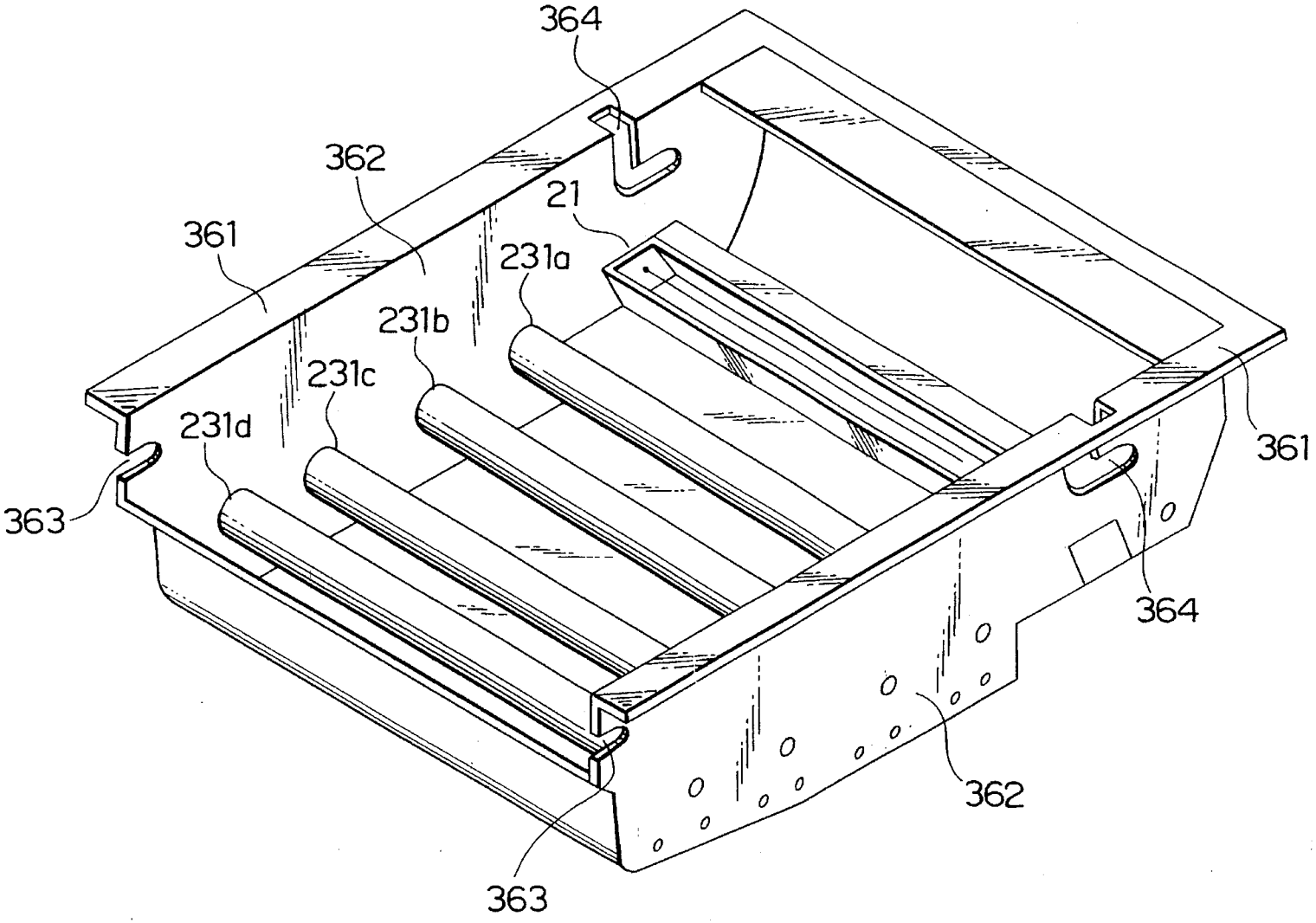
FIG. 10 is a perspective view of the lower unit of the cartridge.

FIG. 6 is a sectional view of the process cartridge 15 according to the present invention. FIG. 7 is a perspective view of the process cartridge 15. FIGS. 8(A) and 8(B) are exploded sectional view of the process cartridge 15. FIG. 9 is a perspective views of the upper unit of the process cartridge 15. FIG. 10 is a perspective view of the lower unit of the process cartridge 15.

The process cartridge 15 comprises: the lower unit which includes the developing units 23*a*, 23*b*, 23*c* and 23*d*, the charging unit 21, and the cleaning means 25;, and the upper unit which includes the drive roller 18 and idle roller 19 to rotate the photoreceptor belt 17 and the image carrier, the gap keeping plate 20*a*, 20*b*, 20*c*, 20*d*, and the backup plate 20*e*. The upper and lower unit are composed in such a manner that they can be combined and separated.

U-shaped casings of the plurality of developing units are formed close to the bottom portion of the lower unit housing 36. The developing sleeves 231*a*, 231*b*, 231*c*, 231*d*, the toner conveyance screws 232*a*, 232*b*, 232*c*, 232*d*, and the stirring screws 233*a*, 233*b*, 233*c*, 233*d* are provided in the U-shaped casings in such a manner that they are rotatably supported by both side walls of the housing 36. A partition plate 234*a* is fixed between the toner conveyance screw 232*a* and the stirring screw 233*a* in the developing unit 23*a*. In the same manner, partition plates 234*b*, 234*c*, 234*d* are respectively provided in the developing units 23*b*, 23*c*, 23*d*.

Scrapers 235*a*, 235*b*, 235*c*, 235*d* are respectively adhered to these partition plates 234*a*, 234*b*, 234*c*, 234*d*, and the tip portions of which are contacted with the cylindrical surfaces of the aforementioned developing sleeves 231*a*, 231*b*, 231*c*, 231*d* with low pressure.

Thin layer forming bars 236*a*, 236*b*, 236*c*, 236*d* are rotatably provided close to the aforementioned developing sleeves 231*a*, 231*b*, 231*c*, 231*d* in such a manner that a predetermined narrow gap is formed between the bar and the developing sleeve.

Numerals 237*a*, 237*b*, 237*c* and 237*d* are baffles to prevent toner from scattering.

A slit 236 is opened in a position close to the charging unit 21 of the aforementioned housing 36 in such a manner that rays of light sent from a laser writing system unit 22 can pass through the slit 236.

The cleaning means 25 is provided on the right side of the charging unit 21, and a cleaning blade 251 and a used toner screw 261 are provided inside the cleaning means 25.

Side plate sections 362, 362 of the aforementioned housing 36 are provided with a horizontal guide groove 363 and an L-shaped guide groove 364 through which end portions 18A, 18A of the drive roller shaft and those 19A, 19A of the idle roller shaft penetrate so that the positioning can be conducted.

The aforementioned drive roller shaft 18A and idle roller shaft 19A are rotatably provided to the side plates 181, 181 of the frame 180 in parallel with each other. The aforementioned gear G14 is provided to one end of the drive roller shaft 18A.

Gap keeping plates 20*a*, 20*b*, 20*c*, 20*d* and a backup plate 20*e* are provided between the side plates 181, 181 of the aforementioned frame 180.

The peripheral surfaces of the gap keeping plates 20*a*–20*d*, the backup plate 20*e*, the drive roller 18 and the idle roller 19 are wrapped by the photoreceptor belt 17, and an appropriate tension is given to the photoreceptor belt 17.

The upper unit of the process cartridge 15 is integrated into the lower unit in such a manner that: the drive roller shafts 18A, 18A and the idle roller shafts 19A, 19A which protrude from the side plates 181, 181 of the frame 180, are set into the aforementioned guide grooves 363, 364, and slid inside the guide grooves 363, 364 until the shafts reaches the end portion of the grooves, and then they are locked by a lock member. In the manner described above, the upper and lower unit are integrated into one body, and positioning is conducted so that the process cartridge 15 is formed.

When inspection or maintenance is conducted on the aforementioned process cartridge, the upper unit can be easily separated from the lower unit by the operator in such a manner that: after the aforementioned lock means has been released, the upper unit is moved horizontally, and then lifted upward. After the upper unit has been removed, the developing units 23(*a*)–23(*d*) are exposed, so that they can be easily inspected and maintained. The upper portion and sides of the photoreceptor belt 17 provided in the upper unit are covered with the frame 180, so that the photoreceptor surface of the belt 17 is scarcely stained during the replacement of the upper unit.

In the aforementioned embodiment, image forming units except for the developing units 23(*a*)–23(*d*), that is, the cleaning means 25 and/or the charging unit 21 may be provided separately from the process cartridge 15.

In this embodiment, the present invention is applied to the image forming process in which a color toner image formed on a photoreceptor belt is transferred onto a transfer sheet when the photoreceptor belt is rotated by one revolution. However, the present invention may be applied to the image forming process in which a toner image is registrated on a toner image previously transferred onto a transfer drum. The present invention can be also applied to a conventional monochrome printer in which a monochrome process is utilized. In the aforementioned embodiment, a non-contact developing method is adopted. However, it should be understood that the present invention is not limited to the non-contact developing method, but it can be applied to a contact developing method.

A transfer drum in which a charging unit is provided in order to electrostatically attract a transfer sheet, may be provided instead of the transfer unit 24 in this embodiment.

The process cartridge is not limited to the specific embodiment in which it is provided in an inclined manner. The process cartridge may be provided horizontally.

A photoreceptor drum may be used for the image carrier to provide in the process cartridge which can be moved.

Next, the second embodiment will be explained as follows.

Figure 11:
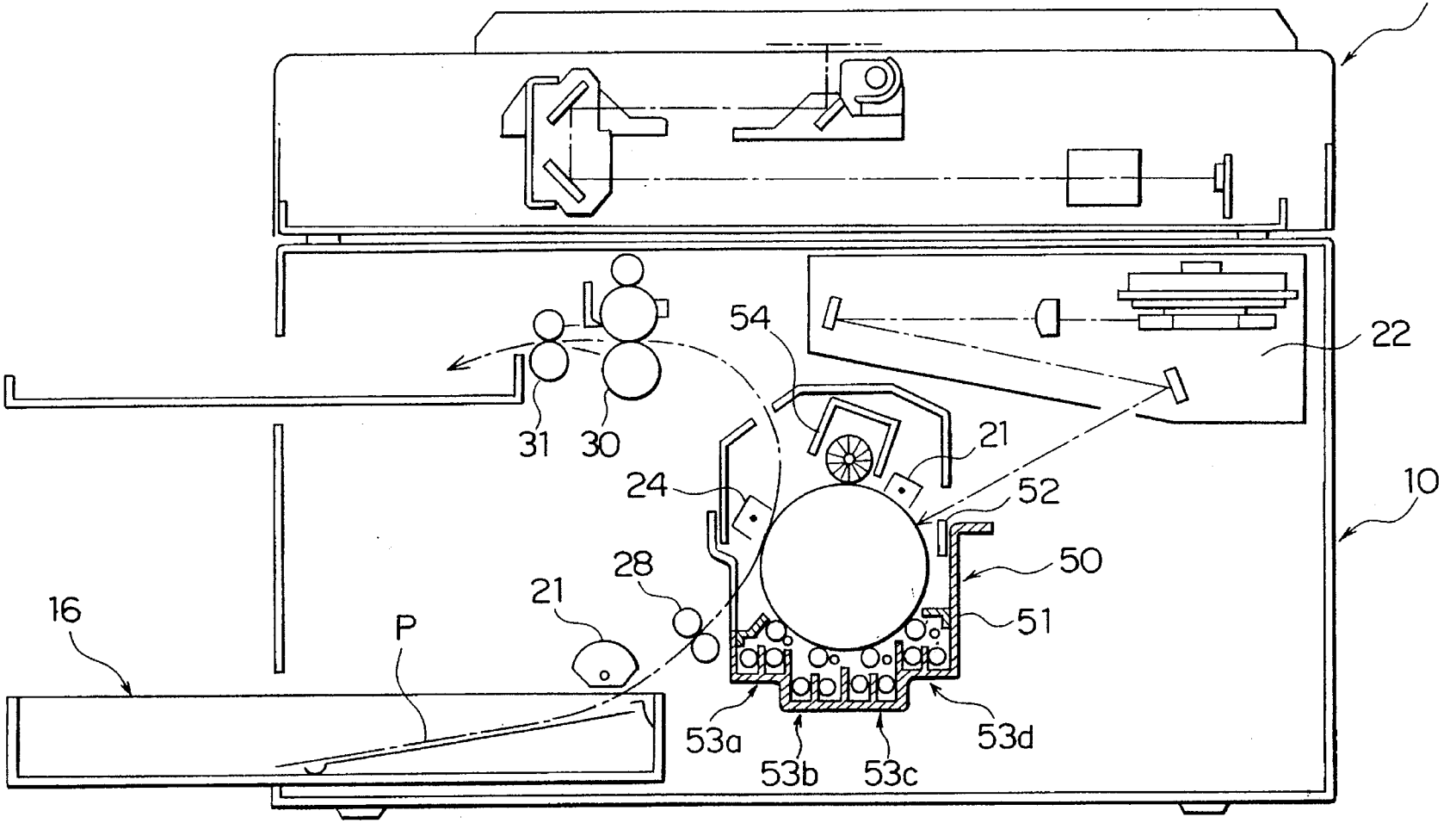
FIG. 11 is a schematic illustration showing the structure of another embodiment of the image forming apparatus according to the present invention.

FIG. 11 shows an image forming apparatus in which a process cartridge 50 having a photoreceptor drum is detachably provided, wherein the process cartridge 50 can be separated into an upper and lower unit. This image forming apparatus is a color copier to the upper portion of which an image reading unit (a scanner) 60 is provided. Like parts in each of the first and second embodiment are identified by the same reference character. The difference between the two embodiments will be explained as follows.

Developing units 53*a*, 53*b*, 53*c*, 53*d* are provided on the bottom of the lower unit of the process cartridge 50, and the casing of each developing unit is formed integrally with the housing 51 of the lower unit.

On the other hand, a charging unit 21, a transfer unit 24 and a cleaning means 54 having a fur brush and a suction opening, are provided to a frame 52 of the upper unit. The aforementioned upper unit can be detached from the lower unit. When the upper unit is detached from the lower unit, the developing units 53(*a*)–53(*d*) are exposed. The cleaning means 54 of the upper unit may be provided separately.

Referring to the attached drawing, the third embodiment of the present will be explained as follows. The essential structure of the third embodiment is the same as that of the aforementioned first embodiment. The difference between the first and third embodiment will be explained referring to FIG. 6 which is a side sectional view of the process cartridge 15 and FIG. 12 which shows the essential portion of the drive system of the process cartridge 15.

Torque of a motor (not shown in the drawing) transmitted to gear G1 is transmitted to gear G2 which meshes with gear G1. When necessary, the torque is transmitted to bevel gear G3 through an electromagnetic clutch C1. Bevel gear G3 and bevel gear G4 meet at a right angle, and the torque transmitted to gear G4 is transmitted to a pinion gear G5. This pinion gear G5 can mesh with a rack gear G6 provided on the side of the process cartridge 15. When pinion gear G5 is rotated and rack gear G5 is slid, the process cartridge 15 can be laterally moved in FIG. 1.

On the side of the process cartridge 15 on which the aforementioned rack gear G6 is provided, are provided a drive gear G11 to rotate the photoreceptor belt 17, developing unit drive gears G12*a*–G12*d*, a used toner screw 261, and a drive gear (not shown in the drawing).

In the process cartridge holding chamber of the apparatus body 10, are provided the guide rail 37 which suspends the process cartridge when the flange portion 361 of the housing 36 of the process cartridge 15 is inserted into the guide rail 37, the aforementioned drive gear G11 of the process cartridge 15, developing unit drive gears G12*a*–G12*d*, and a gear train corresponding to the used toner screw drive gear.

Figure 12:
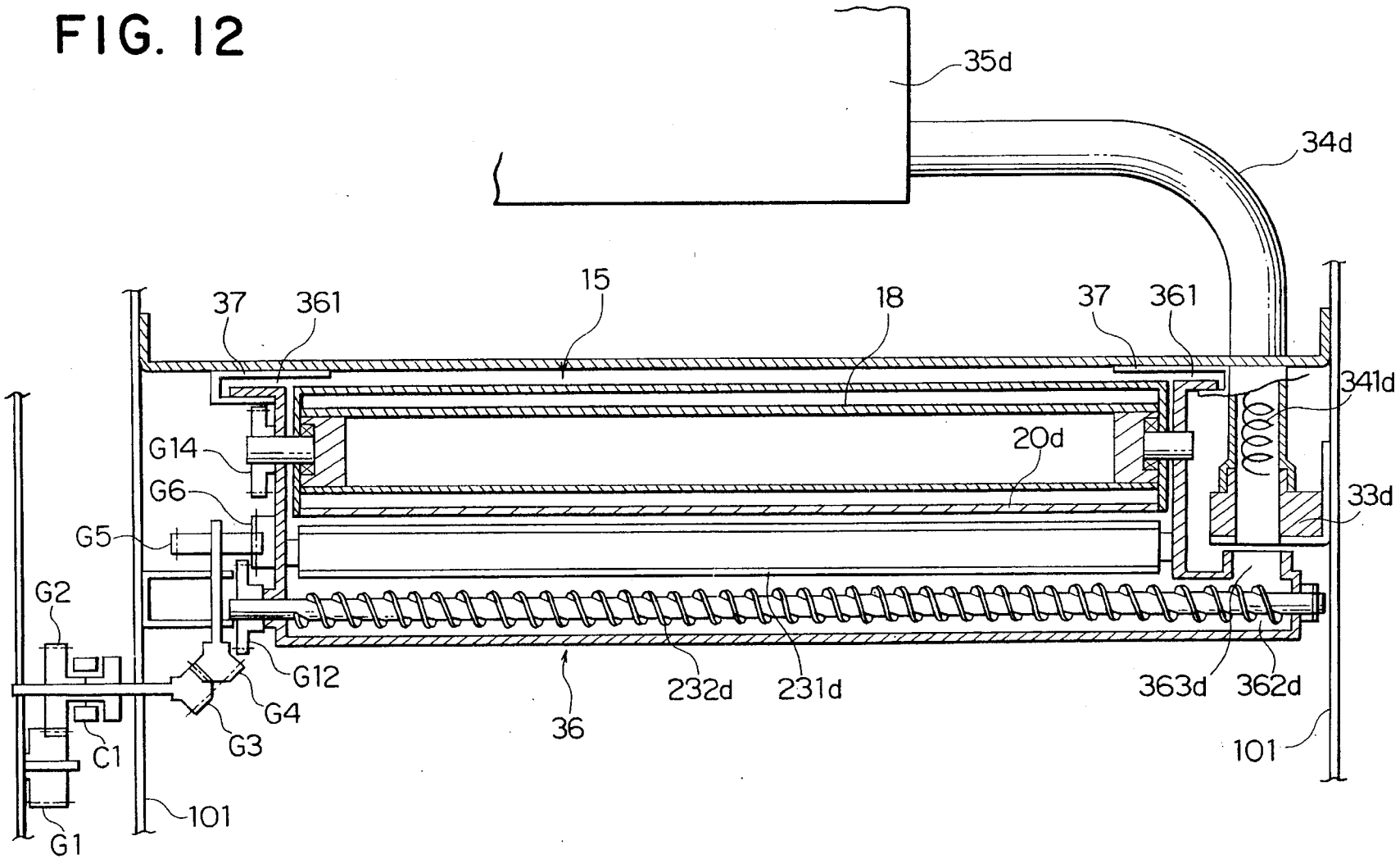
FIG. 12 is a front sectional view of the aforementioned process cartridge which is set to the apparatus body.

FIG. 12 is a front sectional view showing the state in which the process cartridge 15 is set to the apparatus body.

In FIG. 12, a small protruded housing portion 362*d* is formed on one of the side walls (on the right wall in FIG. 12) of the developing tank formed on the bottom of the housing 36 of the process cartridge 15, wherein the small protruded housing portion 362*d* is formed at one shaft end of the aforementioned toner conveyance screw 232*d*, and a toner supply opening 363*d* is formed above the small protruded housing portion 362*d*.

Connecting means 33(*a*)–33(*d*) having a shutter are fixed on one of the side walls 101 of the apparatus body 10, and their openings are coaxially located above the opening portions 363(*a*)–363(*d*) of the aforementioned small housing portions 362(*a*)–362(*d*). Toner supply pipes 34(*a*)–34(*d*) having spiral screws 341(*a*)–341(*d*) are detachably provided to the upper portions of the connecting means 33(a)–33(*d*).

Figure 13:
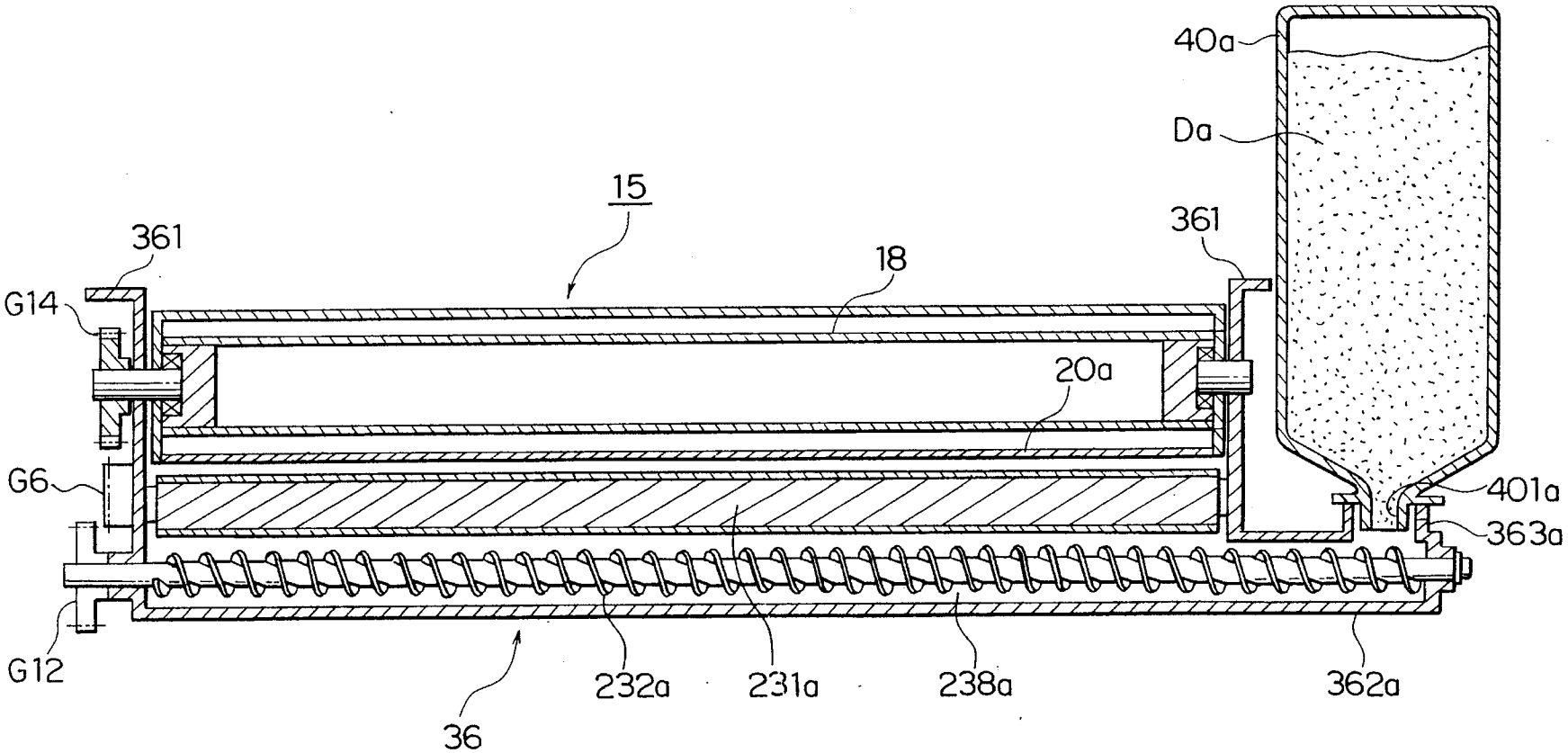
FIG. 13 is a front sectional view of the aforementioned process cartridge to which a developer container is provided.
Figure 14:
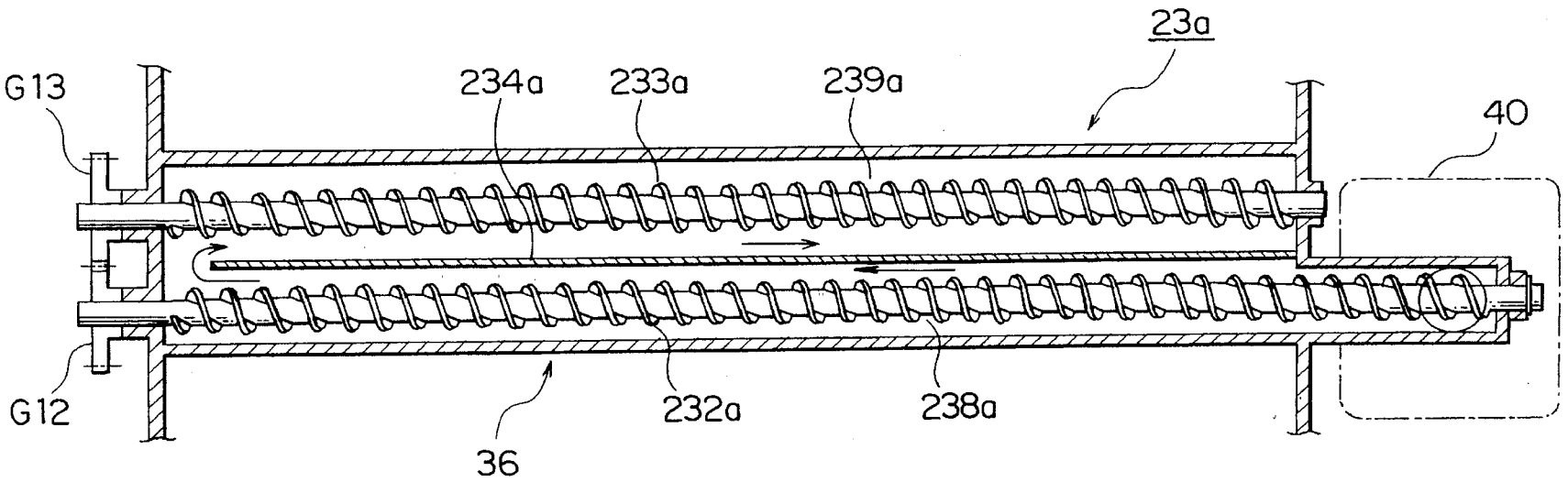
FIG. 14 is a sectional plan view of the main portion of the developing units in the process cartridge.
Figure 15:
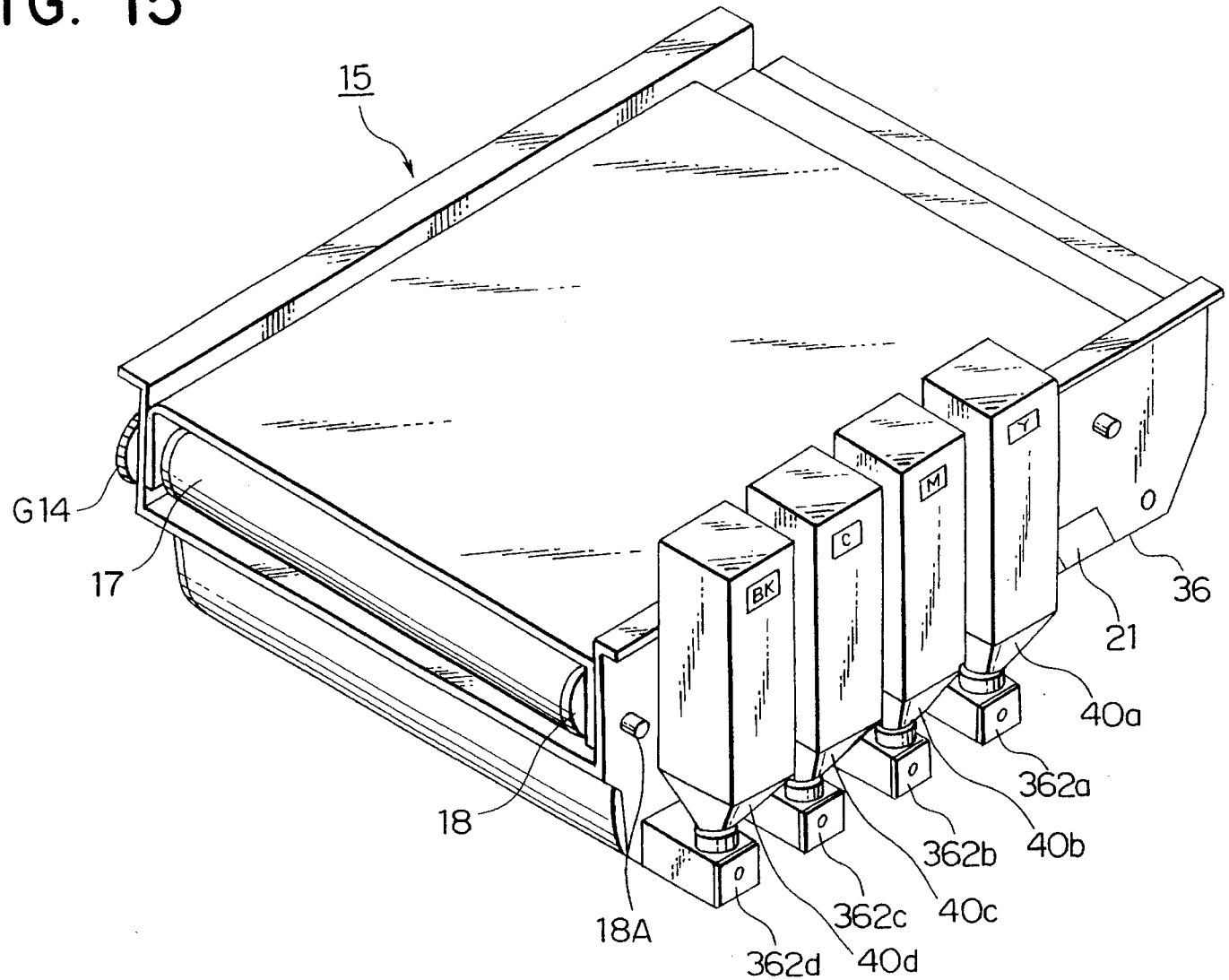
FIG. 15 is a perspective view of the process cartridge and developer container.

The aforementioned toner supply pipes 34(*a*)–(*d*) are connected with toner supply units 35(*a*)–35(*d*). The toner supply units 35(*a*)–35(*d*) are fixed in the upper portion of the process cartridge. The toner supply units 35(*a*)–(*d*) are composed of 4 toner hoppers 351*a*, 351*b*, 351*c*, 351*d* in which, for example, yellow, magenta, cyan, and black toners are loaded, and composed of shutters 352*a*–352*d* which are provided in the respective upper openings. A toner stirring member 353*a* and toner supply screw 354*a* are rotatably provided in the aforementioned toner hopper 351*a*, and intermittently driven by the drive source of the aforementioned developing unit 23*a* and a clutch. Other hoppers 351*b*, 351*c* and 351*d* have the same structure and are driven in the same manner. FIG. 13 is a front sectional view showing the state in which the developer tank 40*a* is assembled to the aforementioned process cartridge 15. FIG. 14 is a sectional plan view showing the essential portion of the developing unit 23*a* of the process cartridge 15. FIG. 15 is a perspective view showing the state in which the developer tank is assembled to the process cartridge.

When the aforementioned process cartridge 15 is pulled out from the apparatus body 10, the openings 363(*a*)–363(*d*) of the small housings 362(*a*)–362(*d*) are opened.

When the process cartridge 15 is assembled or shipped, the developer is not loaded into the developing units 23(*a*)–23(*d*). When new developer is loaded into the aforementioned developing units 23(*a*)–23(*d*), or when the developer is replaced, the process cartridge 15 is pulled out from the apparatus body 10, and then the aforementioned connecting means 33(*a*)–33(*d*) are left in the apparatus body 10 while their openings are closed, and the opening portions 363(*a*)–363(*d*) of the developing units of the process cartridge which has been pulled out, are opened.

Developer containers 40(*a*)–40(*d*) in which new developers D(a)–D(d) are loaded, are tanks made of plastic composed of tank bodies in which a predetermined amount of developer is loaded and discharge sections 401(*a*)–401(*d*) which are opened to the upper end of the tank body.

Next, the developer loading operation will be explained as follows.

(1) When new developers D(a)–D(d) are loaded into the developing units 23(*a*)–23(*d*), they are charged through the opening portions 363(*a*)–363(*d*) of the aforementioned small housing sections 362(*a*)–362(*d*). That is, the developer is charged in such a manner that: the operator holds the developer tank 40*a* in which the aforementioned developer Da is contained and inserts the developer container 40*a* into the aforementioned opening portion 363*a* of the developing unit while the discharge section 401*a* is held downward, and then developer Da in the developing tank 40*a* falls into the space in the aforementioned small housing 362*a*. The developer is piled up in the small housing.

(2) Next, gear G12 which is fixed to the end of the shaft of the toner conveyance screw 232*a*, or gear G13 which meshes with gear G12, is rotated by a hand operation or by means of electrical drive. In the manner described above, developer Da piled up in the small housing 362*a* is conveyed into the first developing tank 238*a* of the developing unit 23*a* by the toner conveyance screw 232*a* so that the developer Da can be conveyed left in the drawing. The conveyed developer Da makes a U-turn at the opening of a partition plate 234*a* close to the left end of developing tank 238*a*, and then enters into the second developing tank 239*a* in which the stirring screw 233*a* is rotatably provided. The developer Da which has entered into the second developing tank 239*a*, is conveyed by the rotation of the stirring screw 233*a* to the right in FIG. 14. Since developer Da in the developer tank 40*a* is conveyed in the manner described above, all developer Da in the developing container 40*a* is charged into the developing tanks 238*a* and 239*a*, so that the developing tank 40*a* becomes empty.

(3) In the same manner described above, developers Db, Dc, Dd are supplied to the developing tanks from the developer containers 40*b*, 40*c*, 40*d* through the openings 363*b*, 363*c*, 363*d* of the developing units 23*b*. 23*c*, 23*d*. FIG. 15 is a perspective view showing the state of developer supply. When some portions or all of the walls of the developer containers 40*a*, 40*b*, 40*c*, 40*d* are made from transparent or translucent material, the state of the developer can be visually checked.

(4) When all of the developer has been supplied to the developing tank, the developer containers 40(*a*)–40(*d*) are removed from the opening portions 363(*a*)–363(*d*) and abandoned. When the process cartridge 15 which has been loaded with developer, is assembled into the apparatus body 10, the opening portions 363(*a*)–363(*d*) of the developing units 23(*a*)–23(*d*) are connected with the connection means 33(*a*)–33(*d*), so that toner can be immediately supplied.

In the aforementioned embodiment, image forming units except for the developing units 23(*a*)–23(*d*), that is, the cleaning means 25 and/or the charging unit 21 may be formed separately from the process cartridge 15.

In this embodiment, the present invention is applied to the image forming process in which a color toner image formed on a photoreceptor belt is transferred onto a transfer sheet when the photoreceptor belt is rotated by one revolution. However, the present invention may be applied to the image forming process in which a toner image is registrated on a toner image previously transferred onto a transfer drum. The present invention can be also applied to a conventional monochrome printer in which a monochrome process is utilized. In the aforementioned embodiment, a non-contact developing method is adopted. However, it should be understood that the present invention is not limited to the non-contact developing method, but it can be applied to a contact developing method.

A transfer drum in which a charging unit is provided in order to electrostatically attract a transfer sheet, may be provided instead of the transfer unit 24 in this embodiment.

The process cartridge is not limited to the specific embodiment in which it is provided in an inclined manner. The process cartridge may be provided horizontally.

The image carrier adopted in the apparatus of the present invention is not limited to a photoreceptor belt. A process cartridge may be adopted to which a photoreceptor drum is applied.

Figure 16:
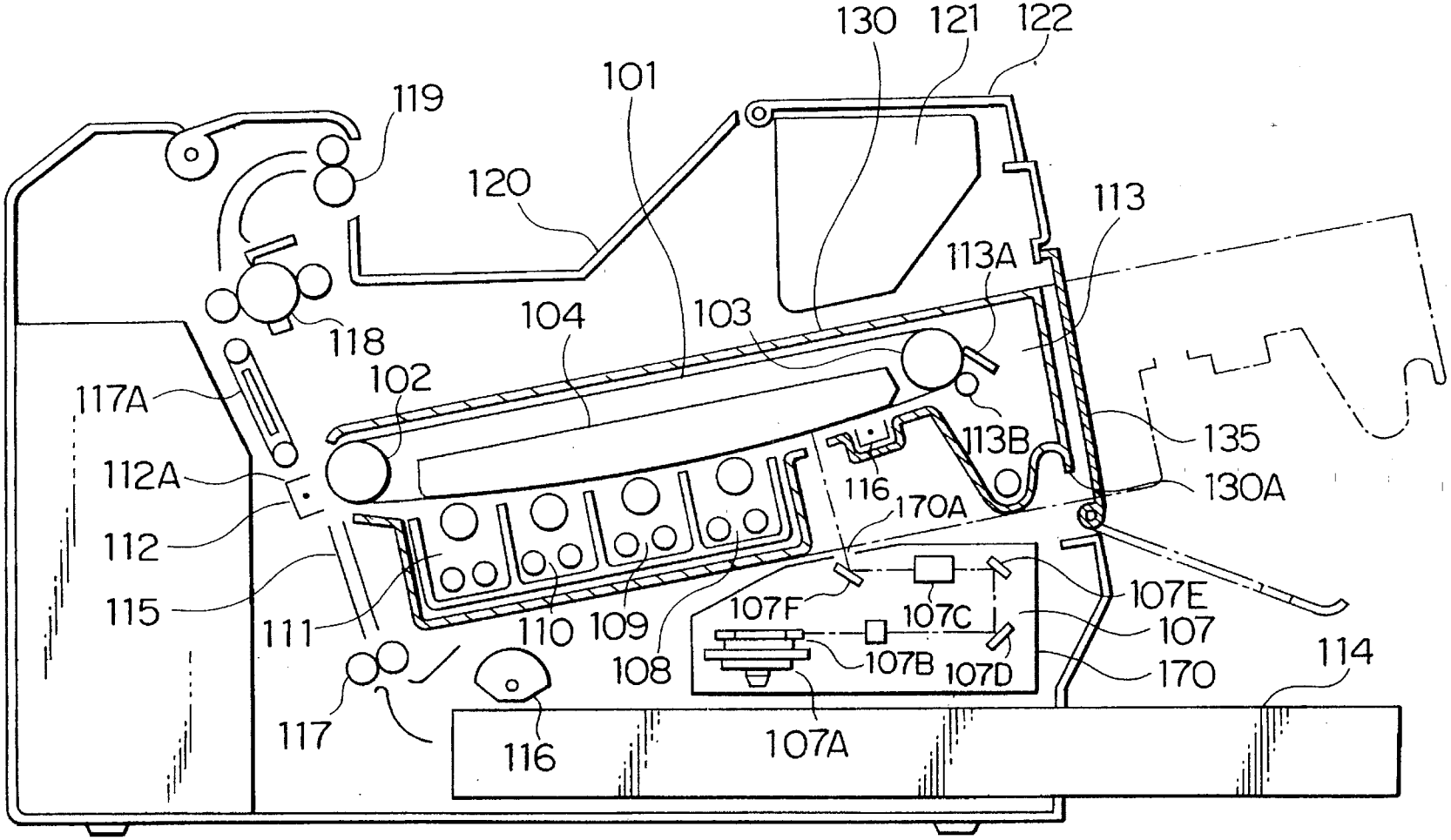
FIG. 16 is a sectional view showing the composition of the color image forming apparatus of the present invention.
Figure 17:
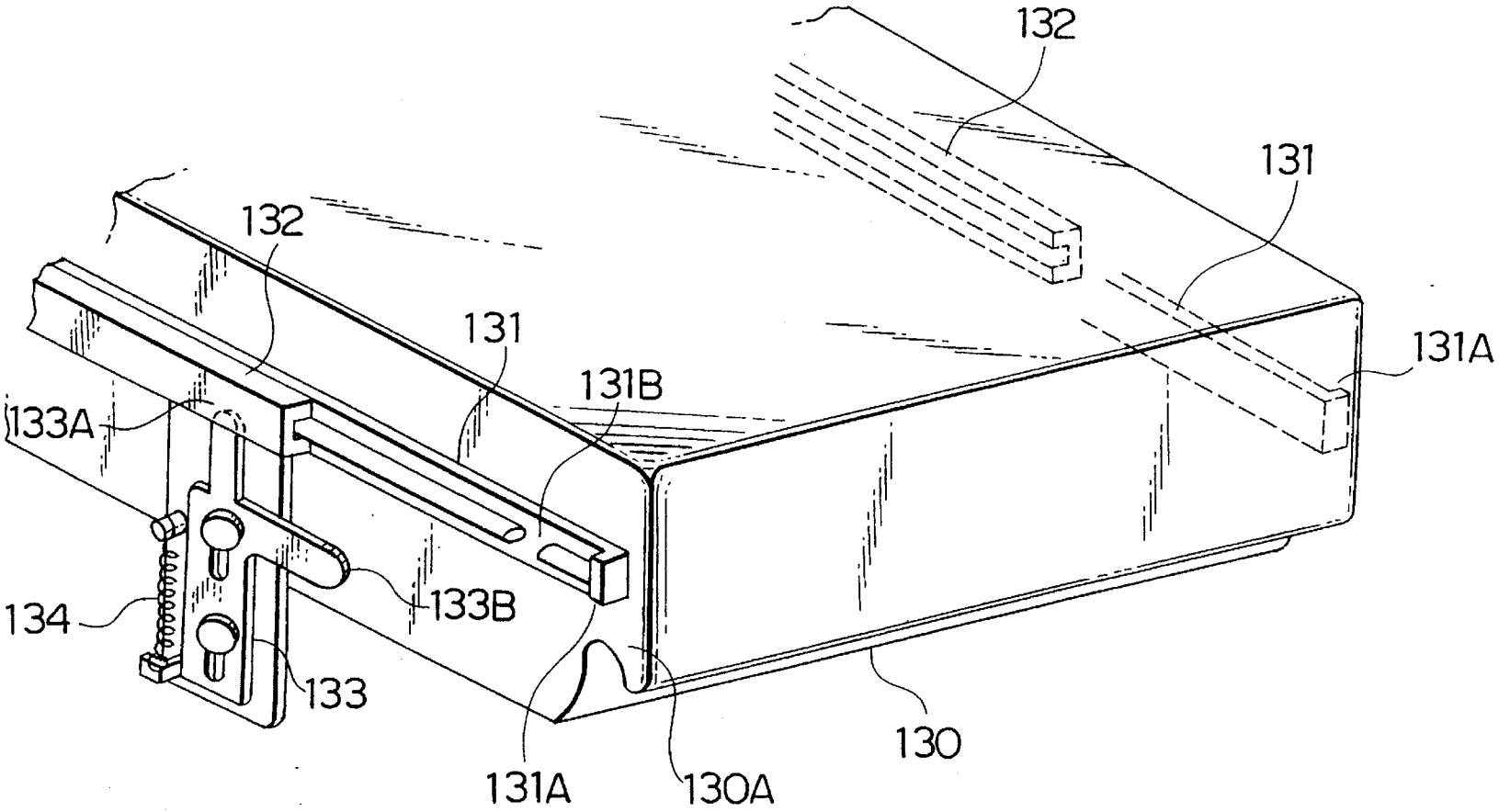
FIG. 17 is a perspective view showing the main portion of the aforementioned apparatus.

Referring to FIG. 16 and FIG. 17, the fourth embodiment of the color image forming apparatus of the present invention will be explained as follows.

In FIG. 16, numeral 101 is a flexible photoreceptor belt which is a belt-shaped image carrier. The photoreceptor belt 101 is provided between rotating rollers 102 and 103, and when the rotating roller 102 is driven, the photoreceptor belt 101 is conveyed clockwise.

Numeral 104 is a guide member which is fixed to an apparatus body in such a manner that the guide member 104 touches internally on the aforementioned photoreceptor belt 101. The aforementioned photoreceptor belt 101 is tensed since the rotating roller 103 is pushed outside, so that the inner peripheral surface of the photoreceptor belt 101 is slidably contacted with the aforementioned guide member 104.

Consequently, even while the aforementioned photoreceptor belt 101 is being rotated, the photoreceptor on the outer peripheral surface of the photoreceptor belt 101 can be maintained at a constant position with regard to the surface of the aforementioned guide member 104, so that a stable image forming surface can be formed on the photoreceptor belt 101.

Numeral 106 is a scorotron charging unit which is used for a charging means. Numeral 107 is a laser writing system unit which is an image exposure means. Numerals 108–111 are a plurality of developing units. These image forming means are installed in the apparatus in such a manner that: the image forming means are opposed to the outer peripheral surface of the aforementioned photoreceptor belt 101, the back of which is opposed no the guide member 104.

The aforementioned laser writing system unit 107 is housed in a housing 170 which is provided with a slit-shaped opening 170A used for exposure, and the housing 170 is assembled into the apparatus body..

Other than the optical system shown in the drawing, an optical system in which a light emitting section and a convergent photoconductor are combined into one unit, is also used for the aforementioned laser writing system unit 107.

The aforementioned developing units 108, 109, 110, 111 contain toners of, for example, yellow, magenta, cyan and black. The developing units are provided with developing sleeves which is located in such a manner that the gap between the aforementioned photoreceptor belt and the developing sleeve is maintained to be a predetermined value, and a latent image formed on the photoreceptor belt 101 is developed into a visual image by means of a non-contact developing method. This noncontact developing method is advantageous in that: the movement of the photoreceptor belt is not obstructed by the developing unit, which is different from the contact developing method.

Numeral 112 is a transfer unit, numeral 112A is a discharge bar, and numeral 113 is a cleaning unit, wherein a blade 113A of the cleaning unit 113 and a conveyance roller 113B are maintained to be in a position separated from the surface of the photoreceptor belt 101 while image formation is being conducted. The blase 113A and the conveyance roller 113B are contacted with the surface of the photoreceptor belt 101 with pressure only when a cleaning operation is conducted after an image has been transferred.

The color image forming process conducted by the aforementioned color image forming apparatus will be described as follows.

In this embodiment, a multi-color image is formed according to the following image formation system. Data obtained by a color image data input section in which an original image is scanned by an image pick-up element, is processed by an image data processing section so that image data can be made. The image data obtained in the manner described above, is once stored in an image memory. When recording is conducted, the stored image data is called out from the image memory, and inputted into a recording section, for example, the color image forming apparatus shown in FIG. 16.

When a color signal outputted from the image reading unit, which is different from the aforementioned printer, is inputted into the aforementioned laser writing system unit 107, a laser beam generated by a semiconductor laser (not shown in the drawing), is rotationally scanned by a polygonal mirror 107B which is rotated by a driving motor 107A, and then the laser beam passes through an fθ-lens 107C, and the optical path of the laser beam is curved by mirrors 107D, 107E, 107F. After that, the laser beam forms a bright line projected on the surface of the photoreceptor belt 101 onto which an electrical charge has been previously given by the charging unit 106.

When scanning has been started, the laser beam is detected by an index sensor, and beam modulation conducted by the first color signal is started, and then the modulated beam scans the surface of the aforementioned photoreceptor belt 101. Accordingly, a latent image corresponding to the first color is formed on the surface of the photoreceptor belt 101 by the primary scanning conducted by the laser beam, and by the auxiliary scanning conducted by the conveyance of the photoreceptor belt 101. This latent image is developed by the developing unit 108 which is loaded with yellow toner so that a yellow (Y) toner image is formed on the surface of the photoreceptor belt. While the obtained toner image is being held on the belt surface, it passes under the cleaning unit 113, and the apparatus starts the next image formation.

The aforementioned photoreceptor belt 101 is charged again by the aforementioned charging unit 106, and then the second color signal outputted from the signal processing section is inputted into the aforementioned writing system unit 107. In the same manner as the first color signal, a writing operation is conducted on the surface of the photoreceptor belt so that a latent image can be formed. The latent image is developed by the developing unit 109 which is provided with the toner of magenta (M), the second color.

This magenta (M) toner is formed under the presence of the yellow (Y) toner which has been already formed.

Numeral 110 is a developing unit which is loaded with cyan (C) toner. The developing unit 110 forms a toner image of cyan (C) on the surface of the photoreceptor belt according to a control signal generated by the signal processing section.

Numeral 111 is a developing unit which is loaded with black toner. In the same manner as described above, a black toner image is formed on the surface of the photoreceptor belt so that it can be registrated on the toner image previously formed. A DC and/or AC bias is applied to the sleeves of the developing units 108, 109, 110, 111, and jumping development is conducted by two component developer, so that non-contact development is conducted on the photoreceptor belt 101, the base of which is grounded. One component developer can be also applied to the apparatus of the present invention.

The color toner image formed on the surface of the photoreceptor belt 101 in the manner described above, is transferred onto a transfer sheet which has been conveyed from a paper feed cassette 114 through a paper feed guide 115.

The uppermost transfer sheet of a stack provided on a paper feed cassette 114, is conveyed when a paper feed roller 116 is rotated, and the conveyed transfer sheet is supplied to a transfer unit 112 by a timing roller 117 being timed to the image formation on the photoreceptor belt 101.

After the toner image has been transferred onto the transfer sheet, the transfer paper is discharged and positively separated from the photoreceptor belt 101 which is sharply curved by the aforementioned rotating roller 102. Then, the transfer sheet is conveyed upward by a suction type of conveyance belt 117A, and the toner image on the transfer sheet is thermally fixed . After that, the transfer sheet is discharged onto a tray formed on an upper lid 120, through a paper discharge roller 119.

On the other hand, after the toner image has been transferred onto the transfer sheet, the photoreceptor belt 101 is further rotated, and the residual toner is removed by the aforementioned cleaning unit 113 in which the blade 113A and the toner conveyance roller 113B are contacted with the photoreceptor belt 101. After the cleaning, the aforementioned blade 113A is separated from the photoreceptor belt 101. A little after that, the toner conveyance roller 113B levels the toner accumulated on the tip of the blade 113A, and then the toner conveyance roller 113B is separated from the photoreceptor belt 101. After that, a new image forming process is started.

The aforementioned photoreceptor belt 101, the charging unit 106, the developing unit, and the cleaning unit 113 are integrated into an independent process cartridge 130, and the process cartridge 130 is assembled to the apparatus from the direction shown by a one-dotted chain line in the drawing.

The aforementioned process cartridge 130 is assembled to the apparatus in such a manner that: as illustrated in FIG. 17, rail members 131 having a protruded section are provided on both sides of the process cartridge 130; U-shaped guide members 132 are installed inside the apparatus; and the rail members 131 are engaged with the guide members 132 so that the process cartridge 130 can be inserted along the guide members 132.

Positioning of the aforementioned process cartridge 130 is conducted in such a manner that the edge 131A of the rail member 131 comes into contact with the guide member 132. At the same time, a tip 133A of an engaging plate 133 provided on the apparatus side is engaged with a cut-out portion 131B of the rail member 131, so that the cartridge 130 can be fixed in the apparatus and the units integrated into the process cartridge 130 can be set to the respective image forming positions.

A handle 130A is formed on the process cartridge 130 in such a manner that a portion of the outer wall forming the aforementioned cleaning unit 113 is protruded so that the handle 130A can be formed.

Accordingly, the process cartridge 130 can be easily attached to and detached from the apparatus body even when a separately-made handle can not be mounted on the process cartridge. Furthermore, the handle 130A is so compact that a side cover 135 can be provided on the front side of the handle 130A.

A portion of the aforementioned engaging plate 133 is formed into a release lever 133B which is protruded to the side of the cartridge 130. When the release lever 133B is pushed downward against the force of a tension spring 134, the aforementioned engaging plate 133 can be withdrawn downward.

Consequently, the process cartridge 130 can be easily removed from the apparatus in such a manner that: under the condition that the cover 135 is opened and the release lever 133B is pushed downward, the aforementioned handle 130A is pulled in the opposite direction to the transfer section.

After the process cartridge 130 has been removed from the apparatus body, the conveyance passage of the transfer sheet and the upper portion of the apparatus are opened only when the aforementioned relatively small upper lid 120 is opened, so that a jammed paper can be easily removed from the apparatus.

Further, only when a small-sized upper cover 122 is opened, toner can be supplied to a toner supply section 121, so that the labor can be saved.

Referring now to the drawings, the fifth embodiment of the apparatus of the present invention will be explained as follows. The essential structure is the same as that of the third embodiment. The different point between the third and fifth embodiment is shown in the exploded sectional view of the process cartridge 15 illustrated in the aforementioned FIGS. 8(A) and 8(B), which will be explained as follows.

The first developing tanks 364(*a*)–(*d*), the second developing tanks 365(*a*)–(*d*), the charging unit 21, the slit 236 through which incident light sent from the optical unit 22 passes, and the used toner screw 261, are provided in the bottom of the process cartridge 15. On both side walls 362 of the housing 36 of the aforementioned process cartridge, are formed a horizontal guide groove 363 and an L-shaped guide groove 364 which can support and position the end portions of the rotating shaft 18A of the drive roller 18, and those of the rotating shaft 19A of the idle roller 19.

The aforementioned drive roller shaft 18A and the idle roller shaft 19A are rotatably provided to both side plates 180, 180 of the frame 150 in parallel with each other. The aforementioned gear G11 is provided to the one end of the shaft of the drive roller 18A.

The gap keeping plates 20*a*, 20*b*, 20*c*, 20*d* and the backup plate 20*e* are provided between both side walls 362 of the aforementioned housing 36.

The photoreceptor belt 17 is wound around the gap keeping plates 20*a*–20*d*, the backup plate 20*e*, the aforementioned drive roller 18, and the idle roller 19 in such a manner that the photoreceptor belt 17 is stretched.

The aforementioned photoreceptor belt 17 is assembled to the housing 36 of the process cartridge 15 in such a manner that: under the condition that the photoreceptor belt 17 is wound around the drive roller 18 and the idle roller 19, the drive roller shaft 18A and the idle roller shaft 19A are set into the aforementioned guide grooves 363, 364 and slid in the guide grooves 363, 364; when the roller shaft has reached the end portion of the guide groove, the drive roller 18 is locked by a conventional lock means not shown in the drawing; and then a tension is given to the idle roller 19 by a spring so that the photoreceptor belt can be stretched. Otherwise, a tension roller may be contacted with a portion of the photoreceptor belt with pressure so that the photoreceptor belt can be stretched.

Figure 18:
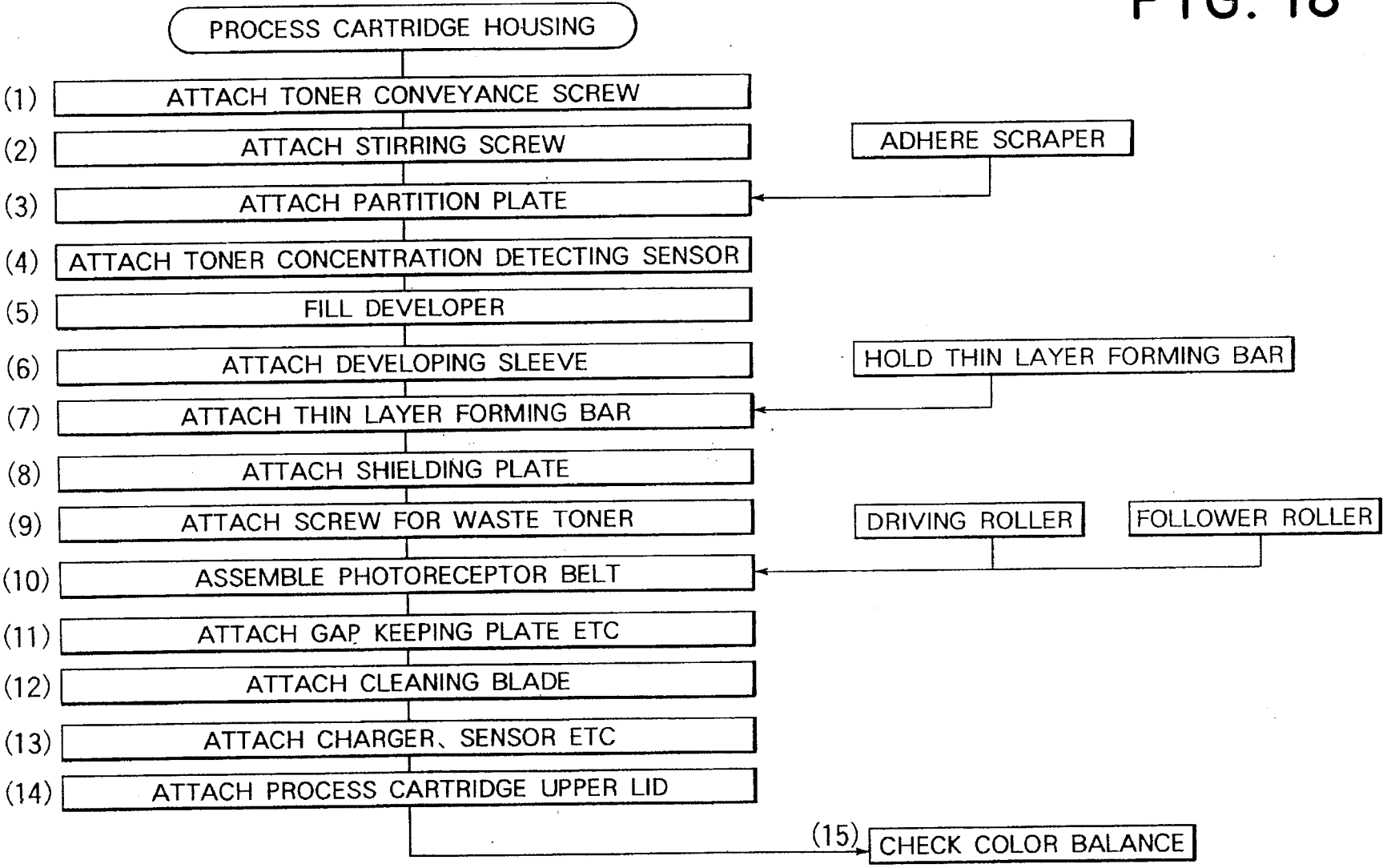
FIG. 18 is a flow chart explaining the assembly process of the aforementioned process cartridge.

FIG. 18 is a flow chart which explains the assembly process of the aforementioned process cartridge 15.

(1) First, the toner conveyance screws 232(*a*)–232(*d*) are rotatably provided in the first developing tanks 364(*a*)–364(*d*) of the aforementioned housing 36. Drive gears G12 (*a*)–G12 (*d*) are fixed to the ends of the toner conveyance screws 232(*a*)–232(*d*).

(2) The stirring screws 233(*a*)–233(*d*) are rotatably provided in the second developing tanks 365(*a*)–365(*d*). Idle gears not illustrated in the drawing are mounted in the ends of the stirring screws 233(*a*)–233(*d*), and the idle gears mesh with the aforementioned drive gears G12(*a*)–G12(*d*).

(3) The partition plates 234(*a*)–234(*d*) onto which the aforementioned scrapers 235(*a*)–235(*d*) are adhered are inserted into the bottom of the housing 36 so that they can be fixed.

(4) A toner concentration detector not shown in the drawing is provided to The aforementioned developing tank.

(5) Developers of various colors are loaded into the spaces of the first and second developing tank into which the toner conveyance rollers 232(*a*)–232(*d*) and the stirring rollers 233(*a*)–233(*d*) are previously provided.

(6) The developing sleeves 231(*a*)–231(*d*) are rotatably provided in the upper portion of the developing tank. Gears not illustrated in the drawing are fixed to the ends of the shafts of the developing sleeves 231(*a*)–231(*d*) so that the developing sleeves 23i(*a*)–231(*d*) can be connected with a drive source not shown in the drawing.

(7) The thin layer forming bars 236(*a*)–236(*d*) are pivotally set and fixed by the set plates 238(*a*)–238(*d*) so that they can be contacted with the cylindrical surfaces of the aforementioned, developing sleeves 231(*a*)–231(*d*) with light pressure. In the manner described above, the upper portions of the second developing tanks 365(*a*)–365(*d*) are shielded.

(8) Shielding plates 237(*a*)–237(*d*) are attached, so that the upper portions of the first developing units 364(*a*)–364(*d*) are shielded except for a toner return slit.

(9) The used toner screw 261 are rotatably provided in the chamber of the cleaning unit 25.

(10) After the drive roller 18 and ,the idle roller 19 have been rotatably provided to the side walls 362 of the aforementioned housing 36 under the condition that the photoreceptor belt 17 is wound around the drive roller 18 and the idle roller 19, a force is given to the idle roller 19 so that the photoreceptor belt 17 can be tensed.

(11) The gap keeping plates 20(*a*)–20(*d*) and the backup plate 20*e* are provided to the wall portions 362 of the housing 36 so that the gap between the photoreceptor belt 17 and the aforementioned developing sleeves 231(*a*)–231(*d*) can be adjusted.

(12) The cleaning blade 251 is mounted in such a manner that the tip of the cleaning blade 251 comes into contact with the outer surface of the photoreceptor belt 17 with pressure.

(13) The charging unit 21 and sensors are mounted so that the assembly of the process cartridge 15 is completed.

(14) The upper lid of the process cartridge is installed.

(15) The process cartridge 15 is loaded into the holding chamber of the image forming apparatus body 10, and test printing is performed in order to check the color balance of an image. When the test results satisfy the standard of evaluation, it is judged that the process cartridge can be shipped.

When the process cartridge is shipped, the upper portions of the developing units 23(*a*)–23(*d*) may be shielded by a seal at the boundary of the developing sleeves 231(*a*)–231(*d*) and the photoreceptor belt 17 in order to prevent the leakage of the developer. Before the process cartridge is set in the image forming apparatus, the aforementioned seal may be easily peeled off.

In the aforementioned embodiment, image forming units except for the developing units 23(*a*)–23(*d*), that is, the cleaning means 25 and/or the charging unit 21 may be provided separately from the process cartridge 15.

In this embodiment, the present invention is applied to the image forming process in which a color toner image formed on a photoreceptor belt is transferred onto a transfer sheet when the photoreceptor belt is rotated by one revolution. However, the present invention may be applied to the image forming process in which a toner image is registrated on a toner image previously transferred onto a transfer drum. In the aforementioned embodiment, a non-contact developing method is adopted. However, it should be understood that the present invention is not limited to the non-contact developing method, but it can be applied to a contact developing method.

A transfer drum in which a charging unit is provided in order to electrostatically attract a transfer sheet, may be provided instead of the transfer unit 24 in this embodiment.

The process cartridge is not limited to the specific embodiment in which it is provided in an inclined manner. The process cartridge may be provided horizontally.

The image carrier adopted in the apparatus of the present invention is not limited to a photoreceptor belt. A process cartridge may be adopted to which a photoreceptor drum is applied.

As the details are described above, in the image forming apparatus of the present invention, the process cartridge can be moved and detached. Under the condition that the process cartridge has been detached from the apparatus body, the upper unit including at least the image carrier can be attached to and detached from the lower unit including the developing unit, so that the inside of the process cartridge can be opened. Consequently, the developing unit and image carrier can be easily assembled, handled and maintained. In the apparatus of the present invention, the casings of the developing units are formed integrally with the housing of the lower unit, so that the accuracy of the positions of a plurality of developing units is extremely high and color balance can be easily adjusted, and the adjusted color balance is stable.

Since the process cartridge can be moved and detached, developer can be easily supplied to the process cartridge which has been removed from the apparatus, so that it is possible to supply developer after the process cartridge has been assembled and adjusted. Accordingly, assembling efficiency of the process cartridge can De ,improved, and the problem that developer is scattered and the surrounding units are stained by the scattered developer, can De solved. Especially in the case of a color image forming apparatus, the aforementioned effects are remarkable. Further, toner can be easily supplied after developer has been loaded.

The structure of the apparatus of the present invention is very simple while the process cartridge can be easily attached to and detached from the apparatus. Accordingly, maintenance can be easily conducted, and a jammed transfer sheet can be easily removed, so that the present invention can provided a color image forming apparatus which can be easily handled and by which a color image of high quality can be .always obtained.

Further, the process cartridge of the color image forming apparatus of the present invention is loaded with necessary developers when it is produced, and adjusted so that it can satisfy the most optimum condition. Accordingly, when a new process cartridge is installed in the apparatus or a spare cartridge is installed in the apparatus, it is not necessary to adjust it, so that time and labor can be saved. Further, a failure in loading developer can be prevented. Color balance of the process cartridge is checked by a manufacturer, so that the quality is guaranteed, and the most optimum color image can be formed immediately after the user has obtained the image forming apparatus.

What is claimed is:

1. An image forming apparatus comprising:

(a) a main body; and (b) a process cartridge detachably mounted on said main body, said process cartridge comprising;

(i) a unit containing a belt-type photoreceptor on which a latent image can be formed, said photoreceptor being stretched around at least two rollers, each of said rollers having shafts at both ends, said unit further containing a support member for supporting said photoreceptor, said support member maintaining a constant distance between a plurality of developing devices and said photoreceptor, wherein said photoreceptor, said rollers, and said support member are integrally formed as said unit, and (ii) a housing comprising a casing for accommodating said plurality of developing devices, provided in series in a conveying direction of said photoreceptor, to develop said latent image, said housing further comprising a charger for charging said photoreceptor, a cleaner for cleaning residual toner from said photoreceptor, and a guide for guiding said shafts of said rollers to position said unit when said unit is mounted on said housing, said unit being detachably mounted on said housing in a substantially vertical direction, whereby a surface of said photoreceptor is positioned opposite said plurality of developing devices.

2. The image forming apparatus of claim 1 wherein, each of said plurality of developing devices has an inlet to receive either a color toner for replenishment or a replacement two-component developer comprising toner and carrier particles, each of said developing devices further comprising rotating conveyors for conveying either said toner or said two-component developer into said developing device.

3. The image forming apparatus of claim 2 further comprising rotating conveyors for conveying either said toner or said two component developer to said developing devices.

4. The image forming apparatus of claim 1 wherein said casing for accommodating a plurality of developing devices is integrally formed with said housing.

5. The image forming apparatus of claim 1 wherein said guide comprises at least one pair of grooves.

* * * * *